US005140886A

United States Patent [19]

Masaki et al.

[11] Patent Number: 5,140,886

[45] Date of Patent: Aug. 25, 1992

[54] MUSICAL TONE SIGNAL GENERATING APPARATUS HAVING WAVEFORM MEMORY WITH MULTIPARAMETER ADDRESSING SYSTEM

[75] Inventors: Kazuo Masaki; Mitsumi Kato, both of Hamamatsu, Japan

[73] Assignee: Yamaha Corporation, Shizuoka, Japan

[21] Appl. No.: 486,051

[22] Filed: Feb. 27, 1990

[30] Foreign Application Priority Data

Mar. 2, 1989 [JP] Japan ..... 1-51265
Mar. 2, 1989 [JP] Japan ..... 1-51266
Mar. 2, 1989 [JP] Japan ..... 1-51267
Mar. 2, 1989 [JP] Japan ..... 1-51268

[51] Int. Cl.[5] ..... G10H 1/057; G10H 1/46; G10H 7/02; G10H 7/12

[52] U.S. Cl. ..... 84/607; 84/616; 84/627; 84/633

[58] Field of Search ..... 84/604–608, 84/615–620, 622–627, 633

[56] References Cited

U.S. PATENT DOCUMENTS 4,566,364 1/1986 Katoh .
4,633,749 1/1987 Fujimori et al. ..... 84/607
4,779,505 10/1988 Suzuki .
4,907,484 3/1990 Suzuki et al. ..... 84/622 X

FOREIGN PATENT DOCUMENTS 0169659 6/1985 European Pat. Off. .
0174547 8/1985 European Pat. Off. .
0235768 2/1987 European Pat. Off. .
55-60191 4/1980 Japan .
60-147793 8/1985 Japan .

*Primary Examiner*—Stanley J. Witkowski
*Attorney, Agent, or Firm*—Graham & James

[57] ABSTRACT

A musical tone signal generating apparatus provides at least a waveform memory which stores a plurality of fundamental waveform data based on three-dimensional coordinate address system having three coordinate axes to which respective musical tone control parameters are assigned respectively. The desirable fundamental waveform data is read out at an address corresponding to a coordinate position determined by selecting desirable musical tone control parameters. Then, an interpolation operation is carried out on the fundamental waveform data which are sequentially read out so that an interpolated musical tone waveform signal is formed. The waveform of the interpolated musical tone waveform signal is similar to and intermediate to the waveforms of the fundamental waveform data to be synthesized. Thus, the interpolated musical tone waveform signal is converted into a musical tone signal, by which corresponding musical tone is to be sounded.

8 Claims, 25 Drawing Sheets

(FIRST EMBODIMENT)

(FIRST EMBODIMENT)

(CONFIGRATION OF WAVEFORM MEMORY)

(WAVEFORM OF FUNDAMENTAL SEGMENT WAVEFORM DATA)

[DATA] WAVEFORM BANK DATA PORTION

| WAVEFORM BANK ADDRESS $ADR_{WBkm}$ | PITCH/LEVEL ADDRESS (i,j) | WAVEFORM DATA : DATA<br>F E D C B A 9 8 7 6 5 4 3 2 1 0 |
|---|---|---|
| ADR WB11 | | PITCH NUMBER CONVERTING COEFFICIENT DATA $PC_{11}$ |
| | | LEVEL NUMBER CONVERTING COEFFICIENT DATA $LC_{11}$ |
| | | PITCH ADDRESS OFFSET DATA $PAO_{11}$ |
| | ( 1,1 ) - ( I,J ) | SAMPLING WAVEFORM DATA $f_{(111)1}$ - $f_{(IJ1)1}$ |
| ⋮ | | |
| ADR WBkm | | PITCH NUMBER CONVERTING COEFFICIENT DATA $PC_{km}$ |
| | | LEVEL NUMBER CONVERTING COEFFICIENT DATA $LC_{km}$ |
| | | PITCH ADDRESS OFFSET DATA $PAO_{km}$ |
| | ( 1,1 )-( I,J ) | SAMPLING WAVEFORM DATA $f_{(11k)m}$ - $f_{(IJk)m}$ |
| ⋮ | | |
| ADRWBKM | | PITCH NUMBER CONVERTING COEFFICIENT DATA $PC_{KM}$ |
| | | LEVEL NUMBER CONVERTING COEFFICIENT DATA $LC_{KM}$ |
| | | PITCH ADDRESS OFFSET DATA $PAO_{KM}$ |
| | ( 1,1 ) - ( I,J ) | SAMPLING WAVEFORM DATA $f_{(11K)M}$ - $f_{(IJK)M}$ |

( DATA CONFIGURATION OF WAVEFORM BANK DATA PORTION [DATA] )

FIG. 4

| WAVEFORM BANK ADDRESS | PICH/LEVEL ADDRESS | WAVEFORM DATA |
|---|---|---|
| ADR WBkm | | PITCH NUMBER CONVERTING COEFFICIENT DATA PCkm |
| | | LEVEL NUMBER CONVERTING COEFFICIENT DATA LCkm |
| | | PITCH ADDRESS OFFSET DATA PAOkm |
| | (1,1) | SAMPLING WAVEFORM DATA f (11)km |
| | (1,2) | f (12k)m |
| | ⋮ | ⋮ |
| | (1,j) | f (1jk)m |
| | ⋮ | ⋮ |
| | (1,J) | f (1Jk)m |
| | ⋮ | ⋮ |
| | (i,1) | f (i1k)m |
| | (i,2) | f (i2k)m |
| | ⋮ | ⋮ |
| | (i,j) | f (ijk)m |
| | ⋮ | ⋮ |
| | (i,J) | f (iJk)m |
| | ⋮ | ⋮ |
| | (I;1) | f (I1k)m |
| | (I,2) | f (I2k)m |
| | ⋮ | ⋮ |
| | (I,j) | f (Ijk)m |
| | ⋮ | ⋮ |
| | (i,J) | f (IJk)m |

| |
|---|
| DATA 0 |
| DATA 1 |
| ⋮ |
| DATA 1023 |

( WAVEFORM DATA OF EACH WAVEFORM BANK ADDRESS )

FIG. 5

SELECTING CONDITION DATA FILE MANEGEMENT DATA PORTION [FILE]

| DIRECTORY NAME | | | FILE DATA | |
|---|---|---|---|---|
| | | | F E D C B A 9 8 7 | 6 5 4 3 2 1 0 |
| KEY CODE DIRECTORY | KEY CODE NUMBER( w ) | 1 | WEIGHTED COEFFICIENT a1 | WAVEFORM NUMBER WBSEL 1 |
| | | | ⋮ | ⋮ |
| | | w | aw | WBSEL w |
| | | | ⋮ | ⋮ |
| | | 128 | a128 | WBSEL 128 |
| PITCH DIRECTORY | DESIGNATED PITCH NUMBER( u ) | 1 | WEIGHTED COEFFICIENT b1x | PITCH NUMBER PNSEL 1 |
| | | | ⋮ | ⋮ |
| | | u | bux | PNSEL u |
| | | | ⋮ | ⋮ |
| | | 128 | b128 | PNSEL 128 |
| ENVELOPE DIRECTORY | DESIGNATED LEVEL NUMBER( v ) | 1 | WEIGHTED COEFFICIENT c1x | LEVELN NUMBER LNSEL 1 |
| | | | ⋮ | ⋮ |
| | | v | cvx | LNSEL v |
| | | | ⋮ | ⋮ |
| | | 128 | c128x | LNSEL 128 |

( DATA CONFIGURATION OF SELECTING CONDITION DATA FILE MANAGEMENT DATA PORTION[FILE])

FIG. 6

WAVEFORM BANK ADDRESS CONVERTING TABLE DATA PORTION [TABLE]

| BANK GROUP SELECTING SIGNAL SEL BANK | WAVEFORM BANK NUMBER WBk | WAVEFORM BANK ADDRESS DATA ADR WBmn | | | | | | | | | | | | | | | |
|---|---|---|---|---|---|---|---|---|---|---|---|---|---|---|---|---|---|
| | | F | E | D | C | B | A | 9 | 8 | 7 | 6 | 5 | 4 | 3 | 2 | 1 | 0 |
| BANK 1 | WB 1 – WB K | ADR WB11 – ADR WBk11 – ADR WBK1 | | | | | | | | | | | | | | | |
| BANK m | WB 1 | ADR WB1m ( UPPER BITS ) | | | | | | | | | ADR WB1m ( LOWER BITS ) | | | | | | |
| | WB k | ADR WBkm ( UPPER BITS ) | | | | | | | | | ADR WBkm ( LOWER BITS ) | | | | | | |
| | WB K | ADR WBKm ( UPPER BITS ) | | | | | | | | | ADR WBKm ( LOWER BITS ) | | | | | | |
| BANK M | WB 1 – WB K | ADR WB1M – ADR WBkM – ADR WBKM | | | | | | | | | | | | | | | |

16 BITS

10 BITS ( DATA CONFIGURATION OF SELECTING CONDITION DATA FILE MANAGEMENT DATA PORTION [FILE])

FIG. 7

(INTERPOLATION IN k-COORDNATION-AXIS DIRECTION)

(WAVEFORM FOR INTERPOLATION)

(INTERPOLATION IN i-COORDINATE-AXIS DIRECTION)

(INTERPOLATION IN J-COORDINATE-AXIS DIRECTION)

(WAVEFORM DATA IN THREE-DIMENSIONAL COORDINATE SYSTEM)

(INTERPOLATION SYNTHESIZING OPERATION OF WAVEFORM MEMORY)

( DETAILED CONFIGURATION OF WAVE FORM MEMORY )

( DETAILED CONFIGURATION OF INTERPOLATION CIRCUIT )

| | | WAVEFORM DATA MEMORY PORTION | FIRST STAGE INTERPOLATION CIRCUIT 33A | | | |
|---|---|---|---|---|---|---|
| | PROCESSING PERIOD | FUNDAMENTAL SEGMENT WAVEFORM DATA | COEFFICIENT LATCH CIRCUIT 37 | COEFFICIENT INPUT CIRCUIT 36 | SHIFT REGISTER 39 | OUTPUT LATCH CIRCUIT 40 |
| OPERATION PERIOD SY1 | T0 | | (LATCH) cv | cv | (CLEAR) | |
| | T1 | fijk | (LATCH) cv | 1-cv | (LOAD) S14A1 | |
| | T2 | fi(j+1)k | (LATCH) cv | cv | (LOAD) S14A1 | (LATCH) S15A1 |
| | T3 | | (LATCH) cv | cv | (CLEAR) | (LATCH) S15A1 |
| | T4 | f(i+1)jk | (LATCH) cv | 1-cv | (LOAD) S14A2 | (LATCH) S15A1 |
| | T5 | f(i+1)(j+1)k | (LATCH) cv | cv | (LOAD) S14A2 | (LATCH) S15A2 |
| | T6 | | (LATCH) cv | cv | (CLEAR) | (LATCH) S15A2 |
| | T7 | fij(k+1) | (LATCH) cv | 1-cv | (LOAD) S14A3 | (LATCH) S15A2 |
| | T8 | fi(j+1)(k+1) | (LATCH) cv | cv | (LOAD) S14A3 | (LATCH) S15A3 |
| | T9 | | (LATCH) cv | cv | (CLEAR) | (LATCH) S15A3 |
| | T10 | f(i+1)j(k+1) | (LATCH) cv | 1-cv | (LOAD) S14A4 | (LATCH) S15A3 |
| | T11 | f(i+1)(j+1)(k+1) | (LATCH) cv | cv | (LOAD) S14A4 | (LATCH) S15A4 |
| SY2 | T0 | | (LATCH) cv | cv | (CLEAR) | (LATCH) S15A4 |
| | T1 | fijk | (LATCH) cv | 1-cv | (LOAD) | (LATCH) S15A4 |
| | T2 | fi(j+1)k | (LATCH) cv | cv | | (LATCH) |

( INTERPOLATION SYNTHESIZING OPERATION )

FIG. 16A (1)

| | | WAVEFORM DATA MEMORY PORTION | | SECOND STAGE INTERPOLATION CIRCUIT 33B | | | |
|---|---|---|---|---|---|---|---|
| | PROCESSING PERIOD | FUNDAMENTAL SEGMENT WAVEFORM DATA | | COEFFICIENT LATCH CIRCUIT 37 | COEFFICIENT INPUT CIRCUIT 36 | SHIFT REGISTER 39 | OUTPUT LATCH CIRCUIT 40 |
| OPERATION PERIOD SY1 | T0 | | | | | | (LATCH) |
| | T1 | fijk | | (LATCH) bu | bu | (CLEAR) | |
| | T2 | fi(j+1)k | | (LATCH) bu | bu | | |
| | T3 | | | (LATCH) bu | 1-bu | (LOAD) S14B1 | |
| | T4 | f(i+1)jk | | (LATCH) bu | 1-bu | (LOAD) S14B1 | |
| | T5 | f(i+1)(j+1)k | | (LATCH) bu | 1-bu | (LOAD) S14B1 | |
| | T6 | | | (LATCH) bu | bu | (LOAD) S14B1 | (LATCH) S15B1 |
| | T7 | fij(k+1) | | (LATCH) bu | bu | (CLEAR) | (LATCH) S15B1 |
| | T8 | fi(j+1)(k+1) | | (LATCH) bu | bu | | (LATCH) S15B1 |
| | T9 | | | (LATCH) bu | 1-bu | (LOAD) S14B2 | (LATCH) S15B1 |
| | T10 | fi(i+1)j(k+1) | | (LATCH) bu | 1-bu | (LOAD) S14B2 | (LATCH) S15B1 |
| | T11 | f(i+1)(j+1)(k+1) | | (LATCH) bu | 1-bu | (LOAD) S14B2 | (LATCH) S15B1 |
| SY2 | T0 | | | (LATCH) bu | bu | (LOAD) S14B2 | (LATCH) S15B2 |
| | T1 | fijk | | (LATCH) bu | bu | (CLEAR) | (LATCH) S15B2 |
| | T2 | fi(j+1)k | | (LATCH) bu | bu | | (LATCH) S15B2 |

( INTERPOLATION SYNTHESIZING OPERATION )

FIG. 16A (2)

| | | WAVEFORM DATA MEMORY PORTION | | THIRD-STAGE INTERPOLATION CIRCUIT 33C | | | |
|---|---|---|---|---|---|---|---|
| | PROCESSING PERIOD | FUNDAMENTAL SEGMENT WAVEFORM DATA | | COEFFICIENT LATCH CIRCUIT 37 | COEFFICIENT INPUT CIRCUIT 36 | SHIFT REGISTER 39 | OUTPUT LATCH CICUIT 40 |
| OPERATION PERIOD SY1 | T0 | | | | | | |
| | T1 | fijk | | | | | (LATCH) |
| | T2 | fi(j+1)k | | (LATCH) aw | aw | (CLEAR) | |
| | T3 | | | (LATCH) aw | aw | | |
| | T4 | f(i+1)jk | | (LATCH) aw | aw | | |
| | T5 | f(i+1)(j+1)k | | (LATCH) aw | aw | | |
| | T6 | | | (LATCH) aw | aw | | |
| | T7 | fij(k+1) | | (LATCH) aw | 1-aw | (LOAD) S14C1 | |
| | T8 | fi(j+1)(k+1) | | (LATCH) aw | 1-aw | (LOAD) S14C1 | |
| | T9 | | | (LATCH) aw | 1-aw | (LOAD) S14C1 | |
| | T10 | f(i+1)j(k+1) | | (LATCH) aw | 1-aw | (LOAD) S14C1 | |
| | T11 | f(i+1)(j+1)(k+1) | | (LATCH) aw | 1-aw | (LOAD) S14C1 | |
| SY2 | T0 | | | (LATCH) aw | 1-aw | (LOAD) S14C1 | |
| | T1 | fijk | | (LATCH) aw | aw | (LOAD) S14C1 | (LATCH) S15C1 |
| | T2 | fi(j+1)k | | (LATCH) aw | aw | (CLEAR) | (LATCH) S15C1 |

( INTERPOLATION SYNTHESIZING OPERATION )

FIG. 16B ( DETAILED CONFIGURATION OF COEFFICIENT GENERATING CIRCUIT )

| PROCESSING PERIOD | FUNDAMENTAL SEGMENT WAVEFORM DATA SIGNAL S2 | MULTIPLCATION OUTPUT SIGNAL S32 |
|---|---|---|
| T20 | fijk | (1-aw)(1-bu)(1-cv)fijk |
| T21 | fi(j+1)k | (1-aw)(1-bu)cvfi(j+1)k |
| T22 | f(i+1)jk | (1-aw)bu(1-cv)f(i+1)jk |
| T23 | f(i+1)(j+1)k | (1-aw)bucvf(i+1)(j+1)k |
| T24 | fij(k+1) | aw(1-bu)(1-cv)fij(k+1) |
| T25 | fi(j+1)(k+1) | aw(1-bu)cvfi(j+1)(k+1) |
| T26 | f(i+1)j(k+1) | awbu(1-cv)f(i+1)j(k+1) |
| T27 | f(i+1)(j+1)(k+1) | awbucvf(i+1)(j+1)(k+1) |
| T20 | fijk | (1-aw)(1-bu)(1-cv)fijk |
| T21 | fi(j+1)k | (1-aw)(1-bu)cvfi(j+1)k |
| - - - - - | - - - - - | - - - - - |

SY11

SY12

(INTERPOLATION SYNTHESIZING OPERATION)

FIG. 19

( SECOND EMBODIMENT )

(CONFIGURATION OF WAVEFORM DATA MEMORY PORTION)

(FUNDMENTAL SEGMENT WAVEFORM DATA)

(LEVEL WAVEFORM OF ENVELOPE SIGNAL)

( THIRD EMBODIMENT )

( WAVEFORM CHANGE-OVER MANNER DUE TO INTERPOLATION COEFFICIENT DATA)

( WAVEFORM CHANGE-OVER MANNER DUE TO INTERPOLATION COEFFICIENT DATA )

(DETAILED CONFIGRATION OF INTERPOLATION CIRCUIT)

MUSICAL TONE SIGNAL GENERATING APPARATUS HAVING WAVEFORM MEMORY WITH MULTIPARAMETER ADDRESSING SYSTEM

BACKGROUND OF THE INVENTION

1. Field of the Invention

The present invention relates to a musical tone signal generating apparatus, and more particularly to a musical tone signal generating apparatus which generates a musical tone signal based on stored waveform data.

2. Prior Art

Japanese Utility Model Laid-Open Publication No. 55-60191 discloses the conventional musical tone signal generating apparatus which synthesizes the musical tone signal by use of plural musical tone control parameters.

More specifically, this conventional apparatus provides two waveform memories each storing different waveform data. The data from the two waveform memories are multiplied by the musical tone control parameter, i.e., a note scaling parameter. Thus, the conventional apparatus forms data for two intermediate waveforms whose amplitudes vary in response to the tone pitch. Then, the data of the two intermediate waveforms data are added together, resulting in that data of one waveform is synthesized. The synthesized waveform data has a waveform which is different from the waveforms originally stored in two waveform memories.

However, this conventional apparatus is disadvantageous in that the synthesized musical tone waveform signal can only offer monotonous variation because the conventional apparatus can merely interpolate two waveforms. For this reason, the conventional apparatus cannot generate a musical tone having various representations.

Actually, the conventional apparatus can use only one musical tone control parameter, i.e., note scaling parameter. As a result, the synthesized musical tone waveform signal cannot offer the complicated variation in tone color, by which the conventional apparatus cannot represent various musical scenes.

Meanwhile, Japanese Patent Laid-Open Publication No. 60-147793 discloses another conventional musical tone signal generating apparatus which can alter the tone color with elapsed time.

In this apparatus, continuous musical tone waveforms of some periods are subject to the sampling process and then stored in the waveform memory as the musical tone waveform of the attack portion. In addition, as the musical tone waveform succeeding the attack portion, plural segment waveforms each corresponding to one period are subject to the sampling process and then stored in the waveform memory. Thereafter, a pair of two segment waveforms is read out, and the read waveform is changed at every predetermined time interval by use of the so-called "cross-fade" method. Thus, the tone color to be sounded is varied.

However, the above-mentioned conventional apparatus is designed to merely read the waveform data from the waveform memory in accordance with the predetermined program, which makes the tone color variation monotonous.

In addition, this conventional apparatus changes the waveform by the cross-fade method at every predetermined time interval, which cannot offer delicate tone color variation of the electronic musical instrument to be performed.

Further, when playing the non-electronic musical instrument, the intensity level of the musical tone (i.e., envelope level of the musical tone) is varied with elapsed time. In addition, the tone color is slightly varied in response to the variation in the intensity level of the musical tone. This is the condition by which the non-electronic musical instrument can offer great representations.

Furthermore, pitch variation is made in order to apply musical effects such as initial-touch and after-touch effects to the musical tone. In this case, if the pitch variation and tone color variation can be simultaneously given to the musical tone, it is possible to obtain the musical tone having great representations. In fact, in the non-electronic musical instrument, when the pitch is varied, the tone color is also slightly varied. Therefore, an electronic musical instrument that can simulate the above-mentioned features of the non-electronic musical instrument is desired.

SUMMARY OF THE INVENTION

It is accordingly a primary object of the present invention to provide a musical tone signal generating apparatus capable of generating a musical tone waveform signal which offers various variations in response to several musical tone control parameters.

It is another object of the present invention to provide a musical tone signal generating apparatus capable of varying tone color in response to the variation of the musical tone level depending on envelope information, expression information, touch information etc.

It is still another object of the present invention to provide a musical tone signal generating apparatus which can cause the tone color variation in response to pitch variation.

In a first aspect of the present invention, there is provided a musical tone signal generating apparatus comprising:

(a) waveform data storing means for storing fundamental waveform data at each memory area having an address corresponding to a coordinate position in n-dimensional coordinate address system, of which each coordinate axis corresponds to each of n musical tone control parameters (where n denotes an integer number);

(b) musical tone designating means for generating musical tone designating information indicative of a musical tone to be generated;

(c) generating means for generating musical tone control parameter information representative of the musical tone control parameter in response to the musical tone designating information;

(d) reading means for reading the fundamental waveform data from the waveform data storing means by selecting certain coordinate position along n coordinate axes in the n-dimensional coordinate address system based on the musical tone control parameter information, so that read fundamental waveform data is used as a musical tone waveform signal; and (e) converting means for converting the musical tone waveform signal into a musical tone signal, whereby a musical tone is to be sounded in accordance with the musical tone signal.

In a second aspect of the present invention, there is provided a musical tone signal generating apparatus comprising:

(a) waveform data storing means for storing a plurality of fundamental waveform data corresponding to a plurality of musical tone control parameters at respective memory areas each having a predetermined address;

(b) musical tone designating means for generating musical tone designating information indicative of a designated musical tone;

(c) generating means for generating musical tone control parameter information in response to the musical tone designating information;

(d) extracting means for extracting desirable fundamental waveform data corresponding to the musical tone designating information from the plurality of fundamental waveform data by use of addresses determined by the musical tone control parameter information, so that a musical tone waveform signal is formed by extracted fundamental waveform data;

(e) weighted coefficient generating means for generating one or more weighted coefficients with respect to one or more fundamental waveform data included in the musical tone waveform signal;

(f) interpolation means for carrying out an interpolation operation on the fundamental waveform data in the musical tone waveform signal by multiplying each fundamental waveform data by each weighted coefficient and then synthesizing its multiplication result to thereby form an interpolated musical tone waveform signal; and (g) converting means for converting the interpolated musical tone waveform signal into a musical tone signal, whereby a musical tone is to be sounded in accordance with the musical tone signal.

In a third aspect of the present invention, there is provided a musical tone signal generating apparatus comprising:

(a) waveform data storing means for storing a plurality of fundamental waveform data corresponding to level variations at memory areas each having a predetermined address;

(b) musical tone designating means for generating musical tone designating information indicative of a designated musical tone;

(c) level information generating means for generating time-variable level information in response to the musical tone designating information, the time-variable level information indicating a level variation occurred in the musical tone waveform;

(d) extracting means for extracting desirable fundamental waveform data corresponding to the musical tone designating information from the plurality of fundamental waveform data by use of addresses determined by the time-variable level information, so that a musical tone waveform signal is formed by extracted fundamental waveform data; and (e) converting means for converting the musical tone waveform signal into a musical tone signal, whereby a musical tone is to be sounded in accordance with the musical tone signal.

In a fourth aspect of the present invention, there is provided a musical tone signal generating apparatus comprising:

(a) waveform data storing means for storing a plurality of fundamental waveform data corresponding to pitch variations at memory areas each having a predetermined address;

(b) musical tone designating means for generating musical tone designating information indicative of a designated musical tone;

(c) pitch information generating means for generating time-variable pitch information in response to the musical tone designating information, the time-variable pitch information indicating a pitch variation occurred in the musical tone waveform;

(d) extracting means for extracting desirable fundamental waveform data corresponding to the musical tone designating information from the plurality of fundamental waveform data by use of addresses determined by the time-variable pitch information, so that a musical tone waveform signal is formed by extracted fundamental waveform data; and (e) converting means for converting the musical tone waveform signal into a musical tone signal, whereby a musical tone is to be sounded in accordance with the musical tone signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIGS. 4 and 5 are tables showing several kinds of data stored in a waveform bank data portion;

FIG. 6 is a table showing a selecting condition data file management data portion;

FIG. 7 is a table showing a waveform bank address converting table data portion;

FIGS. 16A–16B are tables used for explaining the operation of the interpolation circuit;

FIG. 19 is a table used for explaining the interpolation synthesizing operation;

DESCRIPTION OF PREFERRED EMBODIMENTS

[A] FIRST EMBODIMENT (1) Configuration of First Embodiment

Figure 1:
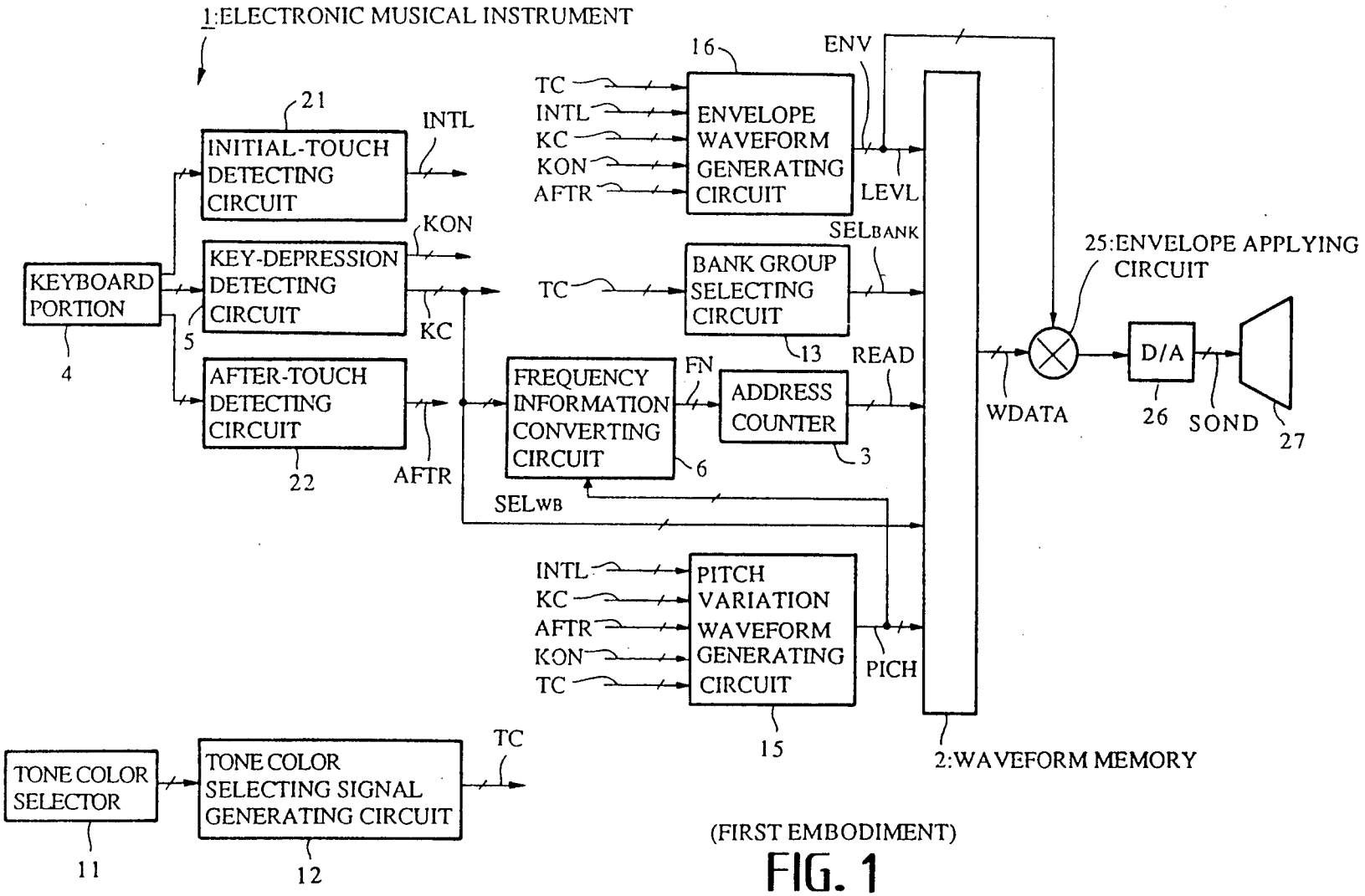
FIG. 1 is a block diagram showing an electrical schematic of an electronic musical instrument using the musical tone signal generating apparatus according to a first embodiment of the present invention.

Referring now to the drawings, wherein like reference characters designate like or corresponding parts throughout the several views, FIG. 1 is a block diagram showing an electrical layout of a monophonic electronic musical instrument 1 according to the first embodiment of the present invention. In FIG. 1, the electronic musical instrument 1 provides a waveform memory 2 which stores plural fundamental segment waveform data (i.e., waveform data of one period) $f_{ijk}$. One of the fundamental segment waveform data $f_{ijk}$ is selected and then repeatedly read from the waveform memory 2 by a waveform reading signal READ which is obtained from an address counter 3. The read fundamental segment waveform data is outputted from the waveform memory 2 as a musical tone waveform signal WDATA.

The waveform memory 2 includes M memory bank groups BANKm (where m=1,2, . . . , M), each of which further includes K waveform banks $WB_k$ (where k=1, 2, . . . , K).

In the first embodiment, the number K of the waveform banks included in each bank group BANKm is set as an arbitrary integer number.

With respect to the tone color assigned to the bank group $BANK_m$ selected by a bank group selecting signal $SWL_{BANK}$, the fundamental segment waveform data $f_{ijk}$ representative of the musical tone corresponding to the tone area including the pitch of each key code are sequentially stored at memory areas each having the predetermined coordinate address.

Figure 2:
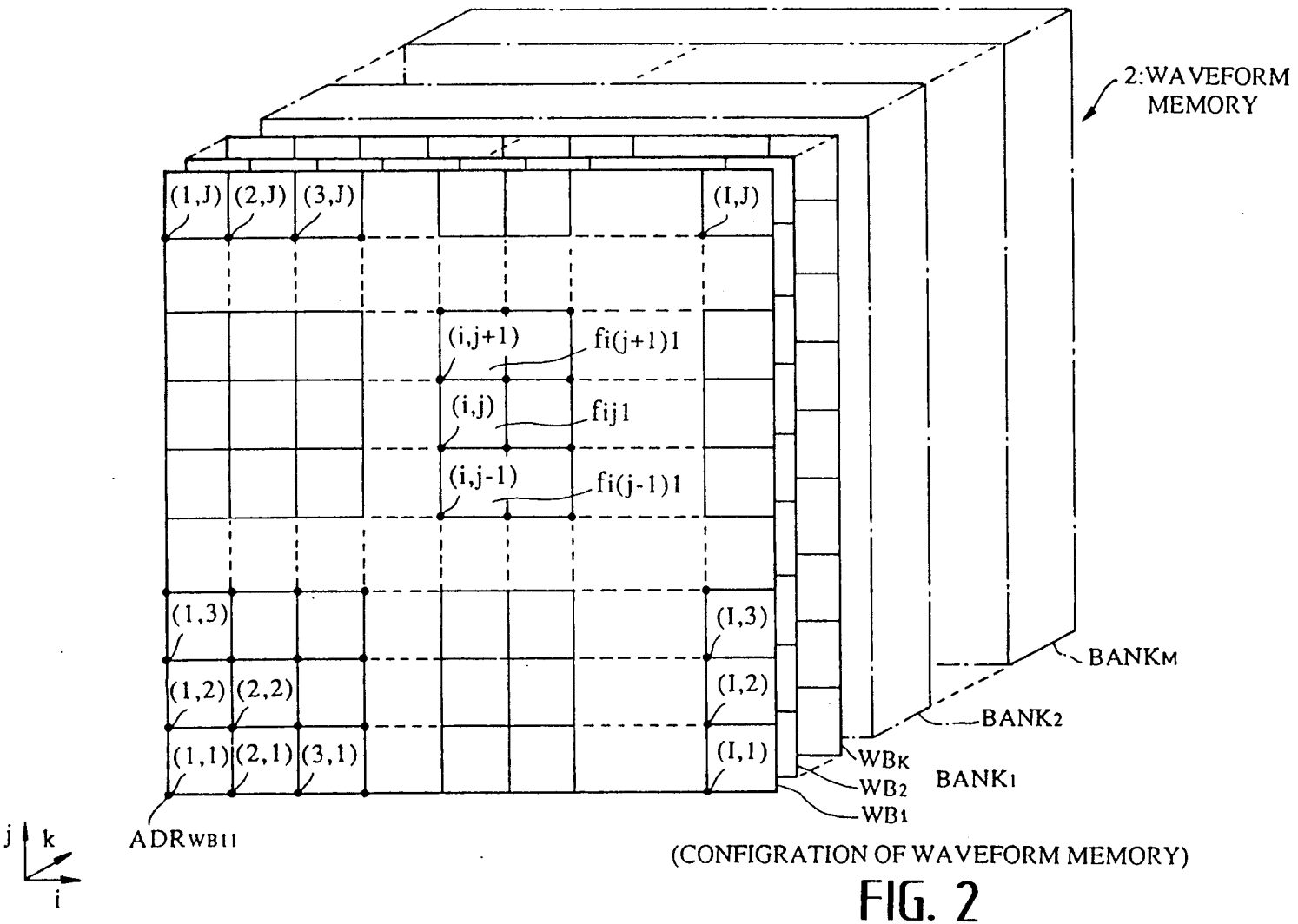
FIG. 2 is a conceptual diagram showing a diagrammatical configuration of a waveform memory shown in FIG. 1.

Herein, FIG. 2 shows the coordinate addresses of the fundamental segment waveform data $f_{ijk}$ stored in the waveform banks WBk (where k=1, 2, . . . , K) included in the bank group BANK1 (where m=1) in detail. These coordinate addresses shown in FIG. 2 can be designated by a three-dimensional coordinate address system including i-coordinate-axis, j-coordinate-axis and k-coordinate-axis. By designating the coordinate address k (where k=1, 2, . . . , K) (which is denoted as tone pitch address) along the k-coordinate-axis, each of waveform banks $WB_1$, $WB_2$, . . . , $WB_K$ can be selected. By designating the coordinate address i (where i=1, 2, . . . , I) (which is denoted as pitch address) along the i-coordinate-axis, each of the coordinate addresses of No.1, No.2, . . . , No.I memory areas included in No.k waveform bank $WB_k$ can be designated. Further, by designating the coordinate address j (where j=1, 2, . . . , J) (which is denoted as level address), each of the coordinate addresses of No.1, No.2, . . . , No.J memory areas included in No.i memory area can be designated.

Herein, the numbers I, J of the memory areas included in each waveform bank are set as arbitrary integer numbers respectively.

When the performer depresses a key of a keyboard portion 4, a key-depression detecting circuit 5 generates a key code signal KC indicative of the key code of the depressed key and a key-on signal KON indicating that the key is depressed. The key code signal KC is supplied to a frequency information converting circuit 6 wherein F-number data FN is generated as frequency information corresponding to the tone pitch of the key code signal KC. The F-number data FN is supplied to the address counter 3.

Figure 3:
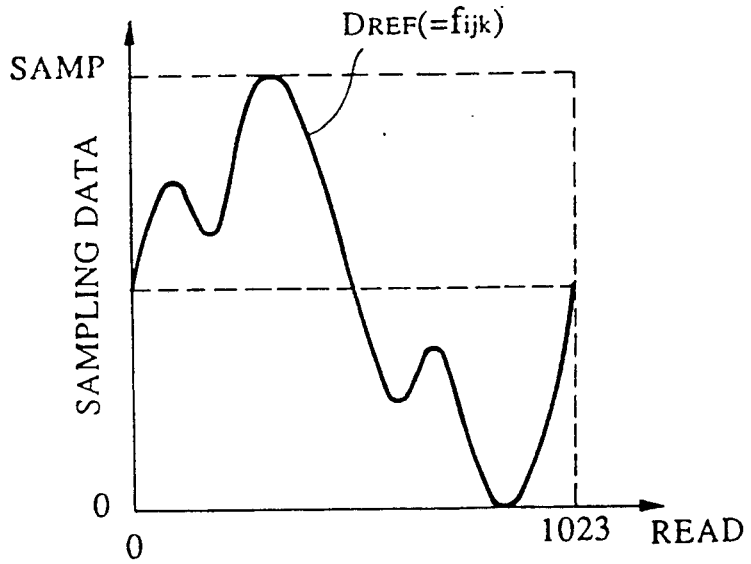
FIG. 3 shows a signal waveform of fundamental segment waveform data.

The address counter 3 accumulates the F-number data FN by every predetermined clock timing. Then, integral part of the accumulation result is used as the waveform reading signal READ. By use of such waveform reading signal READ, the fundamental segment waveform data $f_{ijk}$ having a fundamental segment waveform $D_{REF}$ consisting of No.0-No.1023 sampling data SAMP can be read out by the speed corresponding to the tone pitch of the depressed key as shown in FIG. 3.

The fundamental segment waveform data $f_{ijk}$ to be read out by the waveform reading signal READ is selected based on waveform selecting conditions designated by four pieces of performance information which cause a variation to the fundamental segment waveform $D_{REF}$.

Herein, first performance information is the tone color. When the performer operates a tone color selector 11 (shown in FIG. 1) provided at an operation panel (not shown), a tone color selecting signal generating circuit 12 outputs a tone color selecting signal TC to a bank group selecting circuit 13. The bank group selecting circuit 13 supplies a bank group selecting signal $SEL_{BANK}$ to the waveform memory 2.

In addition, second performance information is the tone pitch. When the key code signal KC is supplied to the waveform memory 2 as a waveform bank selecting signal $SEL_{WB}$, the corresponding waveform bank $WB_k$ is selectively designated. Thus, it is possible to selectively designate the waveform bank $WB_k$ which stores the waveform data corresponding to the tone area including the tone pitch of the depressed key.

In the first embodiment, the number K of the waveform banks $WB_k$ is set smaller than the number of the key codes which can be designated in the keyboard portion 4. For example, this number K is set at "128". Actually, the waveform data having the fundamental segment waveform $D_{REF}$ corresponding to the key code designated by the musical performance is generated by effecting the interpolation based on the fundamental segment waveform data $f_{ijk}$.

The fundamental segment waveform data $f_{ijk}$ is designated by a pitch designating signal PICH and a level designating signal LEVL (which are used as third and fourth performance information respectively). Herein, the pitch designating signal PICH is generated from a pitch variation waveform generating circuit 15, while the level designating signal LEVL is an envelope signal ENV generated from an envelope waveform generating circuit 16.

The pitch variation waveform generating circuit 15 receives an initial-touch signal INTL and an after-touch signal AFTR which are obtained from an initial-touch detecting circuit 21 and an after-touch detecting circuit 22 respectively. These circuits 21, 22 are provided for each key of the keyboard portion 4. In addition, the pitch variation waveform generating circuit 15 further receives the key code signal KC, key-on signal KON and tone color selecting signal TC. The pitch designating signal PICH consists of data of seven bits, for example, indicating the pitch variation waveform determined by initial-touch operation and after-touch operation based o the key code and tone color of the depressed key while the key is depressed.

The envelope waveform generating circuit 16 receives the initial-touch signal INTL, after-touch signal AFTR, key code KC, key-on signal KON and tone color selecting signal TC. Then, the envelope waveform generating circuit 16 generates the envelope signal ENV as the level designating signal LEVL, wherein the envelope signal ENV is formed by the envelop waveform indicating the level variation corresponding to the initial-touch operation and after-touch operation based on the key code and tone color of the operated key during a period between a key-on timing and a key-off timing.

As a result, the waveform memory 2 outputs a musical tone waveform signal WDATA which is multiplied by the envelope signal ENV in an envelope applying circuit 25 which is constructed as a multiplier. Thereafter, the multiplication output of the envelope applying circuit 25 is converted into an analog signal in a digital-/analog (D/A) converter 26. This analog signal is supplied to a sound system 27 as a musical tone signal SOND.

(2) Data Management of Waveform Memory 2

As shown in FIG. 2, data included in one bank group BANKm (i.e., all of fundamental segment waveform data $f_{ijk}$ representative of the same tone color) are managed as the data having coordinate addresses (i, j, k) in the three-dimensional coordinate address system.

Thus, when the performer varies the pitch of the musical tone to be generated, the coordinate address i for the fundamental segment waveform data $f_{ijk}$ to be read out is varied in response to the pitch variation. When the performer varies the envelope level of the musical tone to be generated, the coordinate address j for the fundamental segment waveform data $f_{ijk}$ to be read out is varied in response to such level variation. Further, when the performer changes the key to be operated, the coordinate address k for the fundamental segment waveform data $f_{ijk}$ to be read out is varied in response to the change of the key code which is occurred due to the key change.

Herein, each of No.1 bank group BANK1, No.2 bank group BANK2, . . . , No.M bank group BANKM includes km waveform banks $WB_1$--$WB_{km}$. As shown in FIG. 4, the predetermined coordinate addresses are continuously assigned to the waveform banks. Therefore, by designating the coordinate address for each waveform bank WBk (where k=1−km), it is possible to designate the fundamental segment waveform data $f_{ijk}$ stored in a waveform bank data portion [DATA]of the waveform memory 2.

More specifically, as the head addresses of waveform banks $WB_1, \ldots, WB_K, \ldots, WBK_1$ included in No.1 bank group $BANK_1$, coordinate addresses $ADR_{WB11}, \ldots, ADR_{WBK1}, \ldots, ADR_{WBK11}$ are given. In addition, coordinate addresses $ADR_{WB12}, \ldots, ADR_{WBK2}, \ldots, ADR_{WBK22}$ are respectively assigned to waveform banks $WB_1, \ldots, WB_K, \ldots, WB_{K2}$ included in No.2 bank group $BANK_2$. Similarly, coordinate addresses $ADR_{WB1M}, \ldots, ADR_{WBKM}, \ldots, ADR_{WBKMM}$ are respectively assigned to waveform banks $WB_1, \ldots, WB_K, \ldots, WB_{KM}$ included in No.M bank group $BANK_M$.

In the waveform bank data portion [DATA], each memory area to which the waveform bank address $ADR_{WBkm}$ (where k=1 to Km, m−1 to M) is given stores pitch number converting coefficient data $PC_{km}$, level number converting coefficient data $LC_{km}$ and pitch address offset data $PAO_{km}$ as the waveform data DATA as shown in FIG. 5. These three data $PC_{km}$, $LC_{km}$, $PAO_{km}$ are used as management data which are commonly used with respect to all fundamental segment waveform data $f_{ijk}$ belonging to the corresponding waveform bank. In addition, each memory area also stores sampling waveform data $f_{(ijk)m}$ (where i−1 to $I_{km}$, j=1 to $J_{km}$, k=1 to Km) which makes the fundamental segment waveform data $f_{ijk}$.

Herein, the waveform bank address $ADR_{WBkm}$ indicates the coordinate address of the memory area for storing the waveform data DATA of No.k waveform bank $WB_k$ included in No.m bank group BANKm. FIG. 2 shows a detailed map of the addresses of No.1 waveform bank $WB_1$ within No.1 bank group $BANK_1$. As shown in FIG. 1, the head address of the fundamental segment waveform data $f_{ijk}$ can be designated by the pitch address i (where i=1 to $I_{11}$) and level address j (where j=1 to $J_{11}$).

(3) Read-Out Operation of Waveform Data

In the first embodiment, a selecting condition data file management data portion [FILE] shown in FIG. 6 and a waveform bank address converting table data portion [TABLE]shown in FIG. 7 are provided for each tone color. Meanwhile, the waveform bank address $ADR_{WBkm}$ is required to read out the waveform data DATA of the waveform bank data portion [DATA] as described in FIGS. 4, 5. Such waveform bank address $ADR_{WBkm}$ is formed in the above-mentioned two data portions [FILE], [TABLE] in accordance with the following procedures.

The waveform bank selecting signal $SEL_{WB}$ (see FIG. 1) made by the key code signal KC obtained from the key-depression detecting circuit 5 is applied to the selecting condition data file management data portion [FILE] as key code directory.

Herein, a key code number "w" equals "1", "2", . . . , "128". The selecting condition data file management data portion [FILE] stores file data of sixteen bits with respect to the key code number w (where w=1, 2, . . . , 128). The upper nine bits (i.e., leftmost nine bits) of the file data indicate a weighted coefficient $a_w$ (where w=1, 2, . . . , 128), while the lower seven bits (i.e., rightmost seven bits) of the file data indicate data $WBSEL_w$ (where w=1, 2, . . . , 128) which designates one of the waveform bank numbers WBk (where k=1, 2, . . . , Km).

The specific weighted coefficient $a_w$ is assigned to corresponding one of the key code number w, while any one of the waveform bank number $WB_k$ is set as the data $WBSEL_w$. Thus, the interpolation operation is carried out on the fundamental segment waveform data corresponding to plural key code numbers stored in neighboring waveform banks $WB_k$ and $WB_{k+1}$ by selecting the desirable weighted coefficients "a", wherein neighboring pitch addresses k, k+1 are respectively given to neighboring waveform banks $WB_k$, $WB_{k+1}$.

Figure 8:
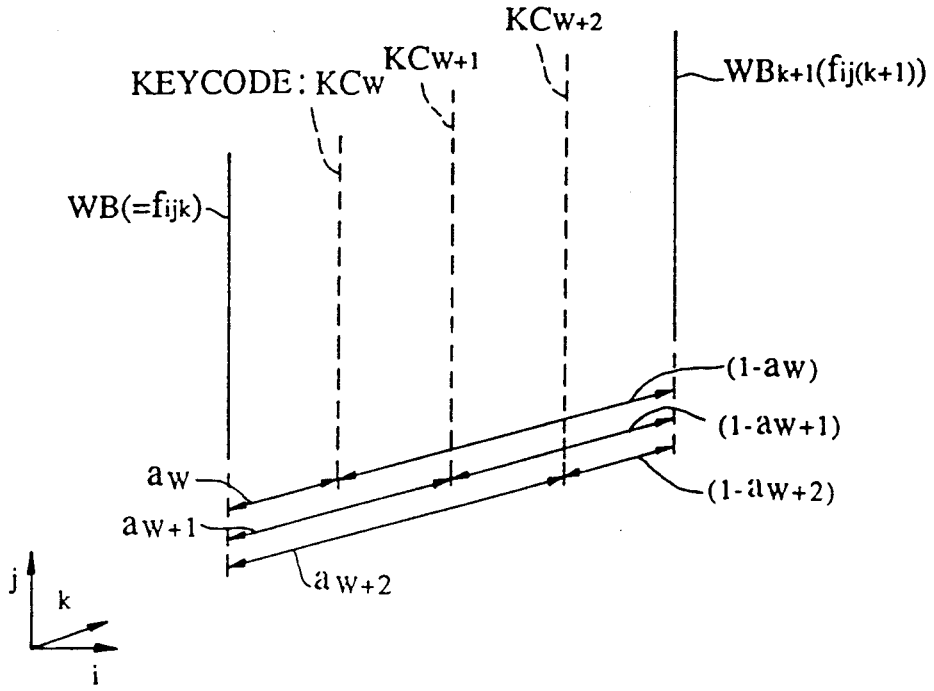
FIGS. 8 to 11 are drawings used for explaining weighted coefficients $a_w$, $b_u$, $c_v$ of the k-coordinate-axis, i-coordinate-axis, j-coordinate-axis.

FIG. 8 shows the case where key codes $KC_w$, $KC_{w+1}$, $KC_{w+2}$ to which key code numbers w, w+1, w+2 are respectively assigned are included within the pitch range between the waveform bank numbers $WB_k$ and $WB_{k+1}$. In this case, weighted coefficient $a_w$ & waveform bank $W_{Bk}$, weighted coefficient $a_{w+1}$ & waveform bank $WB_{k+1}$, weighted coefficient $a_{w+2}$ & waveform bank $WB_{k+2}$ are respectively assigned to three file data corresponding to key codes $KC_w$, $KC_{w+1}$, $KC_{w+2}$.

Thus, the interpolation operation is carried out on the fundamental segment waveform data $f_{ijk}$, $f_{ij(k+1)}$ by use of weighted coefficients $a_w$, $a_{w+1}$, $a_{w+2}$ in the following formulae (1), (2), (3) so that interpolated fundamental segment waveform data $F_w(\omega t)$, $F_{w+1}(\omega t)$, $F_{w+2}(\omega t)$ are computed. Therefore, the interpolated fundamental segment waveform data have respective tone colors intermediate to the tone colors of the fundamental segment waveform data $f_{ijk}$, $f_{ij(k+1)}$.

$$F_w(\omega t)=a_w f_{ijk}+(1-a_w)f_{ij(k+1)} \quad (1)$$

$$F_w(\omega t)=a_{w+1}f_{ijk}+(1-a_{w+1})f_{ij(k+1)} \quad (2)$$

$$F_w(\omega t)=a_{w+2}f_{ijk}+(1-a_{w+2})f_{ij(k+1)} \quad (3)$$

Figure 9:
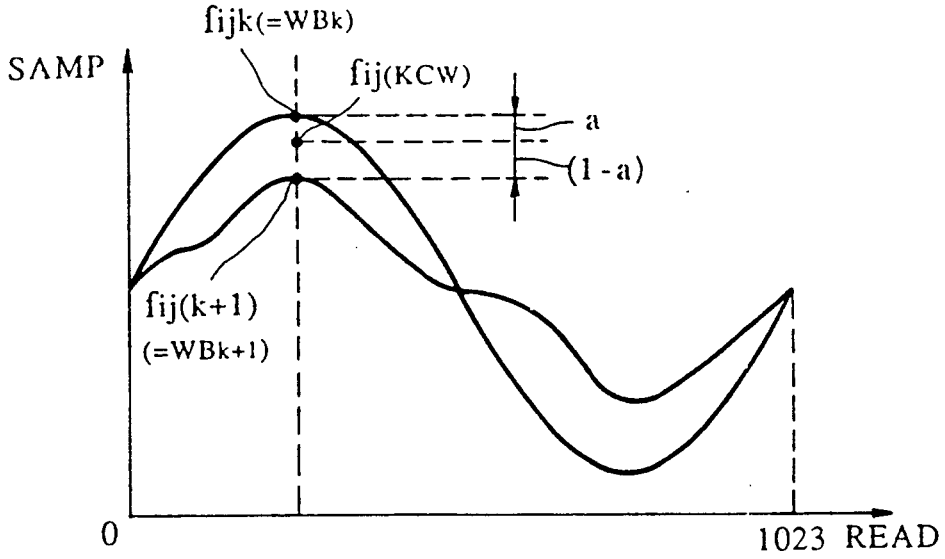

Among these interpolated fundamental segment waveform data, FIG. 9 shows waveforms concerning the interpolated fundamental segment waveform data $F_w(\omega t)$. As shown in FIG. 9, the value of the interpolated fundamental segment waveform data $F_w(\omega t)$ is computed by performing an interior division operation on the fundamental segment waveform data $f_{ijk}$, $f_{ij(k+1)}$ stored in the waveform banks $WB_k$, $WB_{k+1}$ corresponding to the tone pitches which sandwich the designated key code $KC_w$. More specifically, this value of $F_w(\omega t)$ is computed by performing the interior division operation on deviation between $f_{ijk}$ and $f_{ij(k+1)}$ in the k-coordinate-axis direction with a ratio of $a_w:(1-a_w)$. The above-mentioned computation is carried out with respect to each of No.0-No.1023 sampling data.

Therefore, the waveform (representative of the tone color) of the interpolated fundamental segment waveform data $F_w(\omega t)$ has a resemblance to the waveforms (representative of the tone colors) of the fundamental segment waveform data $f_{ijk}$, $f_{ij(k+1)}$, wherein this resemblance depends on the weighted coefficient $a_w$. Herein, as the weighted coefficient $a_w$ becomes closer to "1", the tone color waveform of the interpolated fundamental segment waveform data $F_w(\omega t)$ becomes similar to that of the fundamental segment waveform data $f_{ijk}$. On the other hand, as the weighted coefficient aw becomes closer to "0", the tone color waveform of $F_w(\omega t)$ becomes similar to that of $f_{ij(k+1)}$.

Herein, notation ($\omega t$) indicates a phase signal component which is formed by reading the sampling data SAMP of one period with the waveform reading signal READ in lapse of time as shown in FIG. 3.

Meanwhile, the pitch designating signal PICH outputted from the pitch variation waveform generating circuit 15 (shown in FIG. 1) is given to the selecting condition data file management data portion [FILE] as a pitch directory which designates one of designated pitch numbers u (where u=1, 2, . . . , 128). Based on the pitch directory, it is possible to designate the file data consisting of virtual weighted coefficient $b_{ux}$ and data $PNSEL_u$ (where u=1, 2, . . . , 128) indicative of one of pitch numbers PN (where PN=1, 2, . . . , Im).

Figure 10:
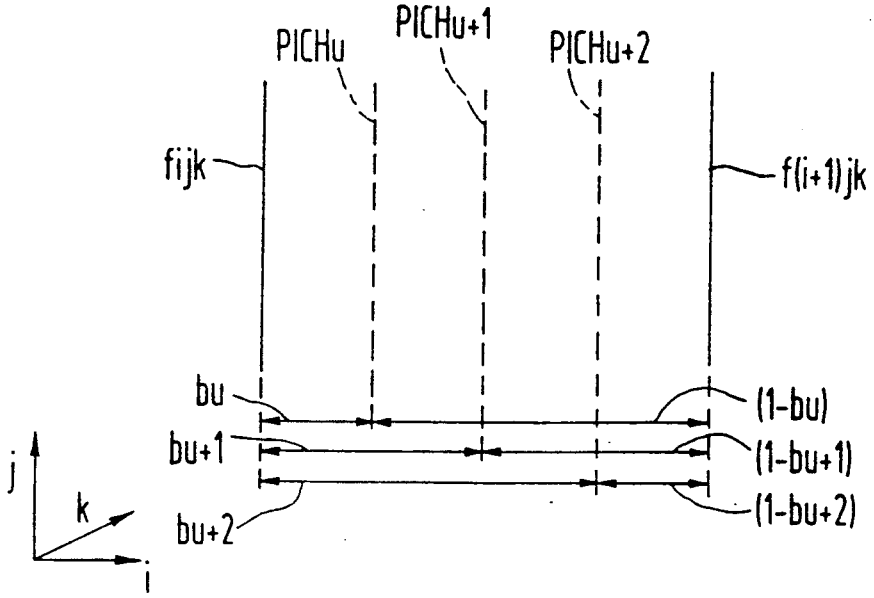

FIG. 10 shows the case where three variation pitches $PICH_u$, $PICH_{u+1}$, $PICH_{u+2}$ are included between the fundamental segment waveform data $f_{ijk}$ and $f_{(i+1)jk}$ corresponding to pitch addresses i, i+1 which are arranged in the i-coordinate-axis direction In this case, weighted coefficient $b_u$ & pitch number $PN_i$, weighted coefficient $b_{u+1}$ & pitch number $PN_i$, weighted coefficient $b_{u+2}$ & pitch number $PN_i$ are stored as the file data of three variation pitches $PICH_u$, $PICH_{u+1}$, $PICH_{u+2}$ respectively. In accordance with the following formulae (4), (5), (6), three interpolated fundamental segment waveform data $F_u(\omega t)$, $F_{u+1}(\omega t)$, $F_{u+2}(\omega t)$ can be computed by effecting the interpolation operation on the fundamental segment waveform data $f_{ijk}$, $f_{(i+1)jk}$ written at pitch addresses i, i+1.

$$F_u(\omega t)=b_u f_{ijk}+(1-b_u)f_{(i+1)jk} \quad (4)$$

$$F_{u+1}(\omega t)=b_{u+1}f_{ijk}+(1-b_{u+1})f_{(i+1)jk} \quad (5)$$

$$F_{u+2}(\omega t)=b_{u+2}f_{ijk}+(1-b_{u+2})f_{(i+1)jk} \quad (6)$$

The above-mentioned interpolated fundamental segment waveform data $F_u(\omega t)$, $F_{u+1}(\omega t)$, $F_{u+2}(\omega t)$ have respective values as similar to the value of the foregoing interpolated fundamental segment waveform data $F_w(\omega t)$ as shown in FIG. 9. For example, the value of $F_u(\omega t)$ is computed by performing the interpolation operation on the fundamental segment waveform data $f_{ijk}$, $f_{(i+1)jk}$ written at pitch addresses i, i+1 corresponding to the pitches which sandwich the pitch corresponding to the designated pitch number u. More specifically, the value of $F_u(\omega t)$ is computed by performing the interior division operation on deviation between $f_{ijk}$ and $f_{(i+1)jk}$ in the i-coordinate-axis direction with a ratio of $b_u:(1-b_u)$. The above-mentioned operation is carried out on each of No.0-No.1023 sampling data.

Therefore, the tone color waveform of the interpolated fundamental segment waveform data $F_u(\omega t)$ has the resemblance to those of the fundamental segment waveform data $f_{ijk}$, $f_{(i+1)jk}$, wherein the resemblance depends on the virtual weighted coefficient $b_u$. Hence, as the weighted coefficient bu becomes closer to "1", the tone color waveform of the interpolated fundamental segment waveform data $F_u(\omega t)$ becomes similar to that of the fundamental segment waveform data $f_{ijk}$. On the other hand, as the weighted coefficient $b_u$ becomes closer to "0", the tone color waveform of $F_u(\omega t)$ becomes similar to that of $f_{(i+1)jk}$.

Meanwhile, the waveform memory 2 receives the envelope signal ENV generated from the envelope waveform generating circuit 16 (see FIG. 1) as the level designating signal LEVL. Then, the level designating signal LEVL is supplied to the selecting condition data file management data portion [FILE] as an envelope directory indicative of a designated level number "v" (where v=1, 2, . . . , 128). Based on this envelope directory, it is possible to designate the file data consisting of a virtual weighted coefficient $c_{vx}$ and data $LNSEL_v$ (where v=1, 2, . . . , 128) indicative of one of level numbers LN (where LN=1, 2, . . . , Jm). By use of the file data, the interpolated fundamental segment waveform data $F_v(\omega t)$ corresponding to the level number u (where u=1, 2, . . . , 128) can be obtained by the interpolation operation.

Figure 11:
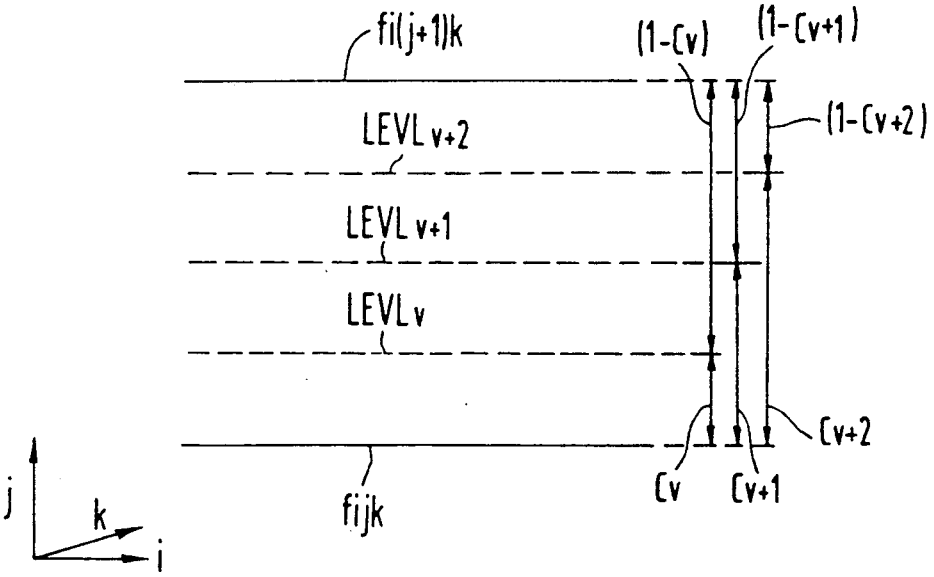

FIG. 11 shows the case where three designated variation levels $LEVL_v$, $LEVL_{v+1}$, $LEVL_{v+2}$ are inserted between fundamental segment waveform data $f_{ijk}$, $f_{i(j+1)k}$ having respective level addresses j, j+1 which are neighboring addresses disposed in the j-coordinate-axis direction. In this case, interpolated fundamental segment waveform data $F_v(\omega t)$, $F_{v+1}(\omega t)$, $F_{v+2}(\omega t)$ are computed in accordance with the following formulae (7), (8), (9) as intermediate data between the fundamental segment waveform data $f_{ijk}$ and $f_{i(j+1)k}$.

$$F_v(\omega t)=c_v f_{ijk}+(1-c_v)f_{i(j+1)k} \quad (7)$$

$$F_{v+1}(\omega t)=c_{v+1}f_{ijk}+(1-c_{v+1})f_{i(j+1)k} \quad (8)$$

$$F_{v+2}(\omega t)=c_{v+2}f_{ijk}+(1-c_{v+2})f_{i(j+1)k} \quad (9)$$

As similar to $F_w(\omega t)$ shown in FIG. 9, each of the interpolated fundamental segment waveform data $F_v(\omega t)$, $F_{v+1}(\omega t)$, $F_{v+2}(\omega t)$ can be obtained by effecting certain operation on the fundamental segment waveform data $f_{ijk}$, $f_{i(j+1)k}$ corresponding to level addresses j, j+1 which further correspond to the levels sandwiching the designated variation level $LEVL_v$. More specifically, each of the interpolated fundamental segment waveform data is computed by effecting the interior division operation on the deviation between $f_{ijk}$, $f_{i(j+1)k}$ in the j-coordinate-axis with a ratio of $c_v:(1-c_v)$. Such operation is effected on each of No.0-No.1023 sampling data.

Therefore, the tone color waveform of the interpolated fundamental segment waveform data $F_v(\omega t)$ has the resemblance to those of the fundamental segment waveform data $F_v(\omega t)$, wherein the resemblance is determined by the weighted coefficient $c_v$. As the weighted coefficient $c_v$ becomes closer to "1", the tone color waveform of the interpolated fundamental segment waveform data $F_v(\omega t)$ becomes similar to that of the fundamental segment waveform data $f_{ijk}$. In contrast, as $c_v$ becomes closer to "0", the tone color waveform of $F_v(\omega t)$ becomes similar to that of $f_{i(j+1)k}$.

In the selecting condition data file management data portion [FILE] (see FIG. 6), when the waveform bank $WB_k$ to be used for the interpolation operation is designated by the key code directory so that the file data $WBSEL_w$ indicative of the designated waveform bank $WB_k$ is read out, the read file data $WBSEL_w$ is converted into a waveform bank address $ADR_{WBkm}$ in the waveform bank address converting table data portion [TABLE] (see FIG. 7).

Herein, M banks $BANK_m$ (where m=1 to M) are selected by the bank group selecting signal $SEL_{BANK}$. With respect to M banks, the waveform bank select data $WBSEL_m$ (where w=1 to K) is converted into the waveform bank address data $ADR_{WBkm}$ (where k=1 to K, m=1 to M) of twenty-six bits in the waveform bank address converting table data portion [TABLE].

The present embodiment provides 26-bit memory area for each address of the memory which stores the waveform bank address data $ADR_{WBkm}$. This 26-bit memory area is divided into two parts, of which the former part stores the upper sixteen bits of $ADR_{WBkm}$ and the latter part stores the lower ten bits of $ADR_{WBkm}$.

As described heretofore, the bank group selecting signal $SEL_{BANK}$ designates the tone color corresponding to No.m tone color bank group $BANK_m$. In this state, when the key code signal KC for reading out No.k waveform bank number is generated by the key code directory the waveform bank address converting table data portion [TABLE] outputs the waveform bank address data $ADR_{WBkm}$.

The above-mentioned waveform bank address data $ADR_{WBkm}$ is supplied to the waveform bank data portion [DATA] as the address data, resulting in that the waveform bank data portion [DATA] is set at the state where the pitch number converting coefficient data $PC_{km}$, level number converting coefficient data $LC_{km}$, pitch address offset data $PAO_{km}$ and sampling waveform data $f_{(11K)m}$ to $f_{(IJK)m}$ can be read out.

Then, by designating the pitch and level addresses (i,j) (where i=1 to $I_{Km}$, j=1 to $J_{Km}$), one of the sampling waveform data $f_{(11K)m}$ to $f_{(IJK)m}$ can be read out.

Meanwhile, the pitch and level addresses (i,j), and interpolation coefficients (b,c) are respectively obtained from the following formulae (10), (11) based on the pitch number select data $PNSEL_u$, level number select data $LNSEL_v$ and virtual interpolation coefficients $b_x$, $c_x$ which are designated by the pitch directory and envelope directory (see FIG. 6).

$$[i, b]=[0, PC_{km}]\times[PNSEL_u, b_x] \quad (10)$$

$$[j, b]=[0, LC_{km}]\times[LNSEL_v, c_x] \quad (11)$$

Herein, the pitch number converting coefficient data $PC_{km}$ and level number converting coefficient data $LC_{km}$ are stored in the waveform bank data portion [DATA] as the common data. In the above-mentioned formulae (10), (11), the notation [x, y] indicates the connected operator wherein x corresponds to the integer part and y corresponds to the decimal part.

Both of the pitch number converting coefficient data $PC_{km}$ and level number converting coefficient data $LC_{km}$ indicate the valid memory areas in connection with each waveform bank number WBk (where k=1 to K). The value ranges of $PC_{km}$, $LC_{km}$ are limited as $PC_{km}=0$ to 1, $LC_{km}=0$ to 1. For this reason, the waveform bank number $WB_k$ for storing the pitch number converting coefficient data $PC_{km}=1$ indicates that the fundamental segment waveform data $f_{ijk}$ (i=1 to $I_{Km}$) are written in all pitch addresses i (where i=1 to Im) in the i-coordinate-axis. Thus, when the pitch number $PN_i$ is designated by the pitch directory (see FIG. 6), the fundamental segment waveform data $f_{ijk}$ (where i=1 to Im) at the pitch address i (where $i=PN_i$) are read out as the waveform which is currently designated.

On the other hand, when the pitch number converting coefficient data $PC_{km}$ is at 0.5 (i.e., $PC_{km}=0.5$), it is indicated that the fundamental segment waveform data $f_{ijk}$ (where i=1 to Im/2) are stored in half of maximum number of addresses. In this case, when the pitch number select data $PNSEL_u$ and virtual interpolation coefficient $b_x$ are designated by the pitch directory, the fundamental segment waveform data $f_{ijk}$ at address i (see following formula (12)) is read out as the waveform data which is currently designated.

$$i=INT([PNSEL_u, b_x]/2) \quad (12)$$

where the notation INT(x) indicates the operator which extracts the integer part of "x".

As similar to the pitch number converting coefficient data $PC_{km}$ described before, the level number converting coefficient data $LC_{km}$ is set at the value representative of the valid memory area at which the fundamental segment waveform data $f_{ijk}$ are actually stored in each waveform bank $WB_k$.

Thus, even if the number of the fundamental segment waveform data $f_{ijk}$ is different with respect to the tone color or tone area, the pitch number $PN_i$ and level number $LN_j$ can be set such that all of the waveform banks $WB_{km}$ will have the same valid memory area. Herein, the number of $f_{ijk}$ corresponds to the memory area which stores the fundamental segment waveform data $f_{ijk}$. In this case, the pitch and level designation can be remarkably simplified.

In the present embodiment, an address portion of an absolute address $[AD(f_{(ijk)m})]$ which simply increases its value as shown in the following formula (13) is assigned to each of the bank groups $BANK_1$ to $BANK_M$ in the waveform memory 2, each of the waveform banks $WB_1$ to $WB_K$ in each bank group, each of the addresses (i=1, j=1 to J), (i=2, j=1 to J), . . . , (i=I, j=1 to J) in each waveform bank and each of No.1-No.1023 sampling data SAMP stored at each address.

$$[AD(f_{(ijk)m})] = ADR_{WBKm} + (PAO_{km}*i) = (1024*j) + AD(u\ t) \quad (13)$$

In the above-mentioned formula (13), first address portion AD(u t) is the absolute address which is assigned to each sampling data SAMP ($=f_{ijk}$) of the fundamental segment waveform $D_{REF}$ (see FIG. 3). Herein, the coordinate address (i.e., pitch address) increments by "1024" indicating the the absolute address corresponding to No.1-No.1023 sampling data SAMP by every memory area.

Second address portion AD(1024*j) indicates the address increment value in the j-coordinate-axis direction. In each of the waveform banks $WB_1$ to $WB_K$, when the pitch address i increments in the i-coordinate-axis direction as i=1, 2, . . . , I, each of the absolute addresses of the coordinate addresses (i=1, j=1, 2, . . . , J), (i=2, j=1, 2, . . . , J), . . . , (i=I, j=1, 2, . . . , J) increments by "1024".

Third address portion $PAO_{km*i}$ indicates the address increment value in the i-coordinate-axis direction. When the pitch address increments in the i-coordinate-axis direction as i=1, 2, . . . , I, the corresponding absolute address is shifted by pitch address offset data $PAO_{km}$ (see FIG. 4) which is prestored in the waveform bank data portion [DATA].

Fourth address portion $AD_{BANKm}(WB_k)$ indicates the head address of the waveform bank $WB_k$ within No.m waveform bank group $BANK_m$.

(4) Interpolation Synthesizing Operation of Waveform Data

The present embodiment carries out the interpolation synthesizing operation as follows. At first, the fundamental segment waveform data $f_{ijk}$ stored in the three-dimensional coordinate address system (i,j,k) is read out from each bank group in the waveform memory 2 by the discrete pitch address i, level address j and tone pitch address k which are used as the head addresses. Then, based on the eight fundamental segment waveform data written at the addresses surrounding the addresses i, j, k, the read fundamental segment waveform data $f_{ijk}$ are synthesized into a synthesized waveform signal $F_{uvw}(\omega t)$ having the pitch variation, level and tone pitch corresponding to the intermediate addresses of the addresses i, j, k.

Figure 12:
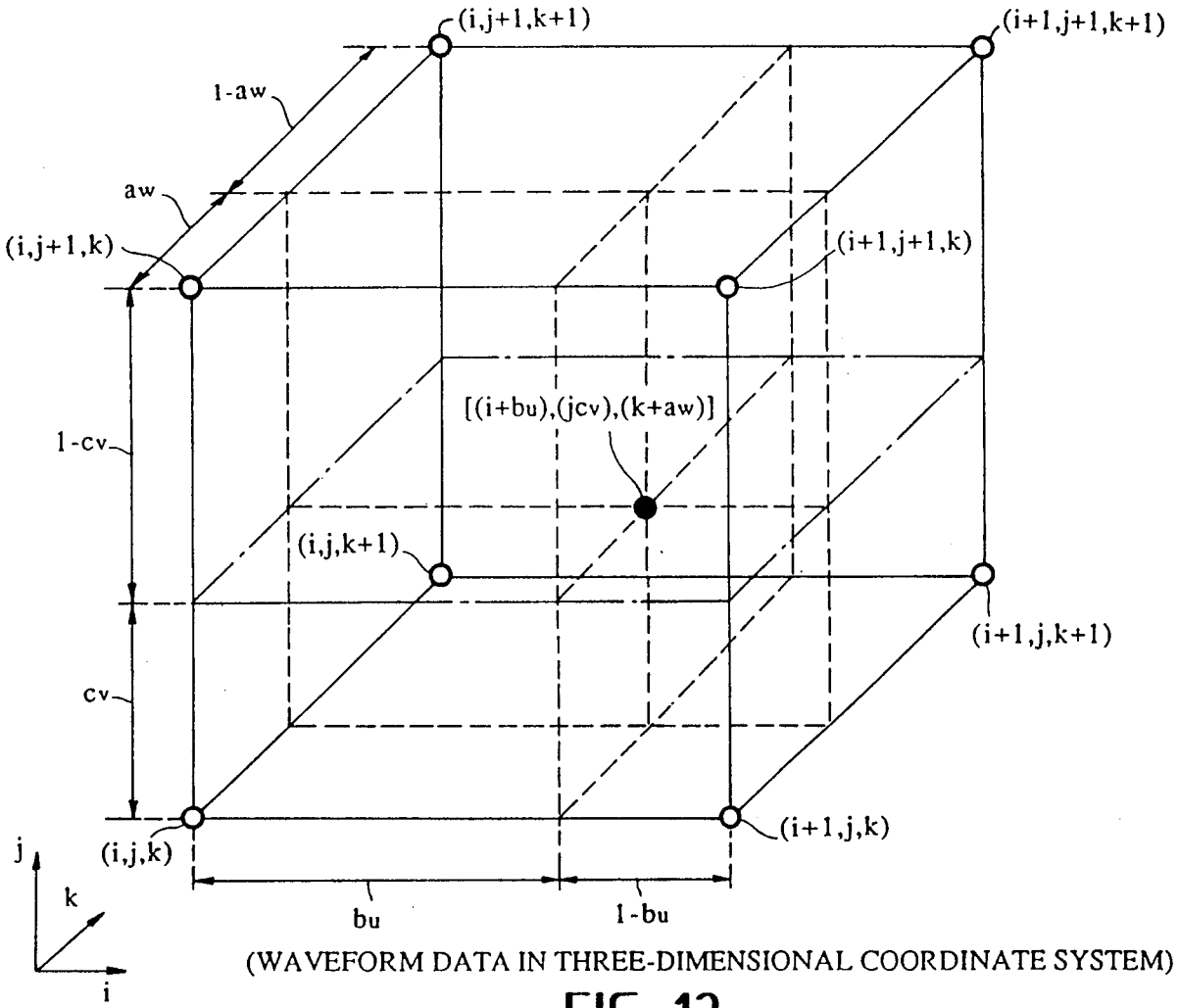
FIGS. 12 and 13 are conceptual drawings used for explaining the interpolation synthesizing operation carried out on the fundamental waveform data in the three-dimensional coordinate address system.

For example, as described in connection with FIGS. 8 to 11, when the present embodiment designate a variation pitch $PICH_u$, variation level $LEVL_v$ and key code $KC_w$ corresponding to the address values between the discrete addresses in k-coordinate-axis, i-coordinate-axis and j-coordinate-axis directions respectively, the weighted coefficients $b_u$, $c_v$, $a_w$ for the file data are designated by the key code directory, pitch directory and envelope directory (see FIG. 6). By use of the weighted coefficients $b_u$, $c_v$, $a_w$ and eight fundamental segment waveform data $f_{ijk}$, $f_{(i+1)jk}$, $f_{(i+1)j(k+1)}$, $f_{ij(k+1)}$, $f_{i(j+1)k}$, $f_{(i+1)(j+1)k}$, $f_{(i+1)(j+1)(k+1)}$, $f_{i(j+1)(k+1)}$ (see FIG. 13) having head addresses (i, j, k), (i+1, j, k), (i+1, j, k+1), (i, j, k+1), (i, j+1, k), (i+1, j+1, k), (i+1, j+1, k+1), (i, j+1, k+1) which respectively correspond to surrounding eight coordinates as shown in FIG. 12, the interpolation operation is carried out on the waveform data corresponding to coordinate $[(i+b_u), (j+c_v), (k+a_w)]$ in the three-dimensional coordinate system so that the synthesized waveform data $F_{uvw}(\omega t)$ is obtained by the computation according to the following formula (14), whereby the pitch variation, level, and tone pitch of the musical tone to be generated can be obtained.

$$\begin{aligned} F_{uvw}(wt) = {} & a_w b_u c_v f_{ijk} + \\ & a_w b_u (1 - c_v) f_{i(j+1)k} + \\ & a_w (1 - b_u) c_v f_{(i+1)jk} + \\ & a_w (1 - b_u)(1 - c_v) f_{(i+1)(j+1)k} + \\ & (1 - a_w) b_u c_v f_{ij(k+1)} + \\ & (1 - a_w) b_u (1 - c_v) f_{i(j+1)(k+1)} + \\ & (1 - a_w)(1 - b_u) c_v f_{(i+1)j(k+1)} + \\ & (1 - a_w)(1 - b_u)(1 - c_v) f_{(i+1)(j+1)(k+1)} \end{aligned} \quad (14)$$

Figure 13:
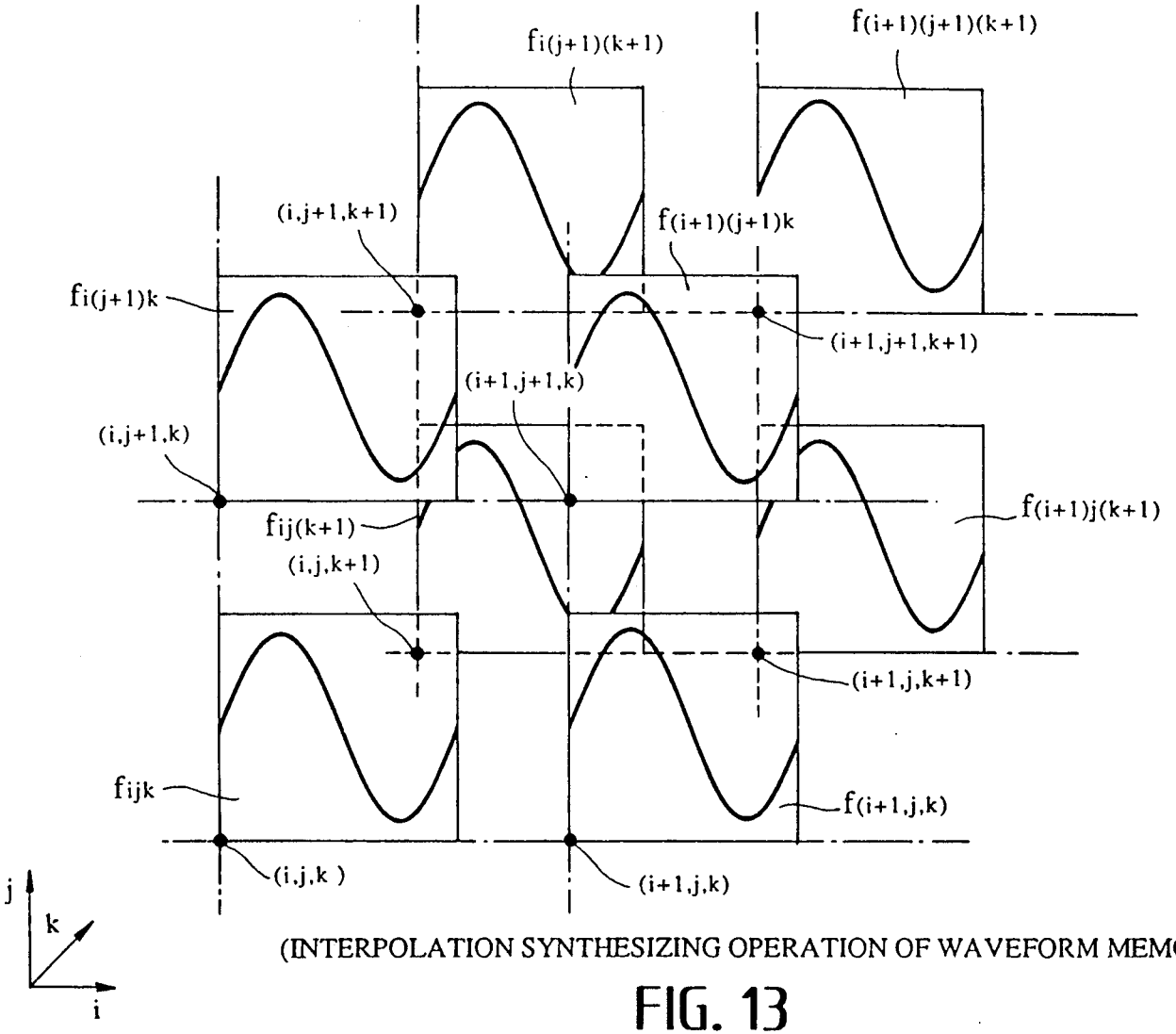

In the above-mentioned formula (14), $f_{ijk}$, $f_{(i+1)jk}$, $f_{(i+1)j(k+1)}$, $f_{ij(k+1)}$, $f_{i(j+1)k}$, $f_{(i+1)(j+1)k}$, $f_{(i+1)(j+1)(k+1)}$, $f_{i(j+1)(k+1)}$ are sample data of the fundamental segment waveform data respectively stored at the coordinate addresses (i, j, k), (i+1, j, k), (i+1, j, k+1), (i, j, k+1), (i, j+1, k), (i+1, j+1, k), (i+1, j+1, k+1), (i, j+1, k+1) (see FIG. 13).

As described before in connection with FIGS. 8 to 10, the synthesized waveform signal $F_{uvw}(\omega t)$ corresponds to the coordinate position (i.e., interpolated address) $(i+b_u, j+c_v, k+a_w)$ which is obtained by effecting the interior division operation on eight coordinate points with a ratio of $b_u:c_v:a_w$. In addition, each term in the foregoing formula (14) can be translated such that each fundamental segment waveform data is incorporated in the synthesized waveform data $F_{uvw}(\omega t)$ as its synthesized waveform component in response to the distance between the above-mentioned interpolated address and each of eight coordinate points.

As all of the weighted coefficients $b_u$, $c_v$, $a_w$ become closer to "1", the interpolated address $(i+b_u, j+c_v, k+a_w)$ becomes closer to address (i+1, j+1, k+1). In addition, among all of the signal components of the synthesized waveform signal $F_{uvw}(\omega t)$ (see foregoing formula (14)), the coefficient component $a_w b_u c_v$ for the fundamental segment waveform data $f_{ijk}$ becomes closer to "1". On the other hand, the other coefficient components $a_w b_u(1-_v)$ to $(1-a_w)(1-b_u)(1-c_v)$ for $f_{i(j+1)k}$ to $f_{(i+1)(j+1)(k+1)}$ become closer to "0". Thus, the waveform of the synthesized waveform signal $F_{uvw}(\omega t)$ becomes similar to that of the fundamental segment waveform data $f_{ijk}$ stored at address (i,j,k).

In contrast, as all of the weighted coefficients $b_u$, $c_v$, $a_w$ become closer to "0", the coordinate address position $(i+b_u, j+c_v, k+a_w)$ becomes closer to address (i,j,k). In addition, among all the signal components of $F_{uvw}(\omega t)$, the coefficient component $(1-a_w)(1-b_u)(1-c_v)$ for $f(i+1)(j+1)(k+1)$ becomes closer to "1". On the other hand, the other coefficient components $(1-a_w)(1-b_u)c_v$ to $a_wb_uc_v$ for $f_{(i+1)j(k+1)}$ to $f_{ijk}$ become closer to "0". Thus, the waveform of the synthesized waveform signal $F_{uvw}(\omega t)$ becomes similar to that of the fundamental segment waveform data $f_{(i+1)(j+1)(k+1)}$ stored at address (i+1, j+1, k+1).

Similarly, as the weighted coefficient $a_w$ becomes closer to "0", the waveform of the synthesized waveform signal $F_{uvw}(\omega t)$ becomes similar to the waveforms of the fundamental segment waveform data $f_{ij(k+1)}$, $f_{i(j+1)(k+1)}$, $f_{(i+1)j(k+1)}$, $f_{(i+1)(j+1)(k+1)}$ stored at four addresses (i, j, k+1), (i, j+1, k+1), (i+1, j, k+1), (i+1, j+1, k+1) respectively. On the other hand, as $a_w$ becomes closer to "1", the waveform of the synthesized waveform signal $F_{uvw}(\omega t)$ becomes similar to the waveforms of the fundamental segment waveform data $f_{ijk}$, $f_{i(j+1)k}$, $f_{(i+1)jk}$, $f_{(i+1)(j+1)k}$ stored at addresses (i,j k). (i. j+1, k), (i+1, j, k), (i+1, j+1, k).

By selecting the predetermined value as the weighted coefficient aw according to needs as described heretofore, it is possible to obtain the interpolated address in the k-coordinate-axis direction in each waveform bank group $BANK_m$ (where m=1, 2, . . . , M). Based on the interpolated address, it is possible to obtain the synthesized waveform signal $F_{uvw}(\omega t)$ indicating the waveform representative of the tone pitch of the musical tone corresponding to the key code signal KC by carrying out the interpolation synthesizing operation.

As described above, with respect to the interpolated fundamental segment waveform corresponding to each key code signal KC which can be synthesized, the present embodiment selects the weighted coefficient $b_u$ in the i-coordinate-axis direction and another weighted coefficient $c_v$ in the j-coordinate-axis direction. Thus, it is possible to synthesize the musical tone waveform by carrying out the interpolation operation when the pitch variation and/or level variation is occurred in the musical tone.

As a result, even if the number K of the waveform banks $WB_k$ (where k=1 to K) included in each bank group $BANK_m$ (where m=1 to M) is smaller than the number of the key codes (i.e., 128 key codes in the present embodiment) which can be designated by the key code signal KC, the present embodiment can set one or more weighted coefficients $a_w$ for the waveform bank $WB_k$ so that the present embodiment can obtain the interpolated fundamental segment waveform data stored in the waveform banks corresponding to all key codes by carrying out the interpolation operation.

Similarly, in the case where the present embodiment requires a plurality of pitch variation stages whose number is larger than the maximum address number I in the i-coordinate-axis direction with respect to each waveform bank $WB_k$, one or more weighted coefficients bu are set for the neighboring fundamental segment waveform data $f_{ijk}$, $f_{(i+1)jk}$ in the i-coordinate-axis direction. In this case, therefore, the present embodiment can obtain fundamental segment waveform data of which waveforms are different from each other in response to a plurality of pitch variation stages.

Further, in the case where the present embodiment requires a plurality of level variation stages whose number is larger than the maximum address number J in the j-coordinate-axis direction with respect to each waveform bank $WB_k$, one or more weighted coefficients $c_v$ are set for the neighboring fundamental segment waveform data $f_{ijk}$, $f_{i(j+1)k}$ in the j-coordinate-axis direction. In this case, the present embodiment can obtain the interpolated fundamental segment waveform data in connection with a plurality of level variation stages.

(5) Detailed Configuration of Waveform Memory

Next, description will be given with respect to the detailed configuration of the waveform memory 2 by referring to FIG. 14, wherein the waveform synthesizing operation is carried out as described before.

Figure 14:
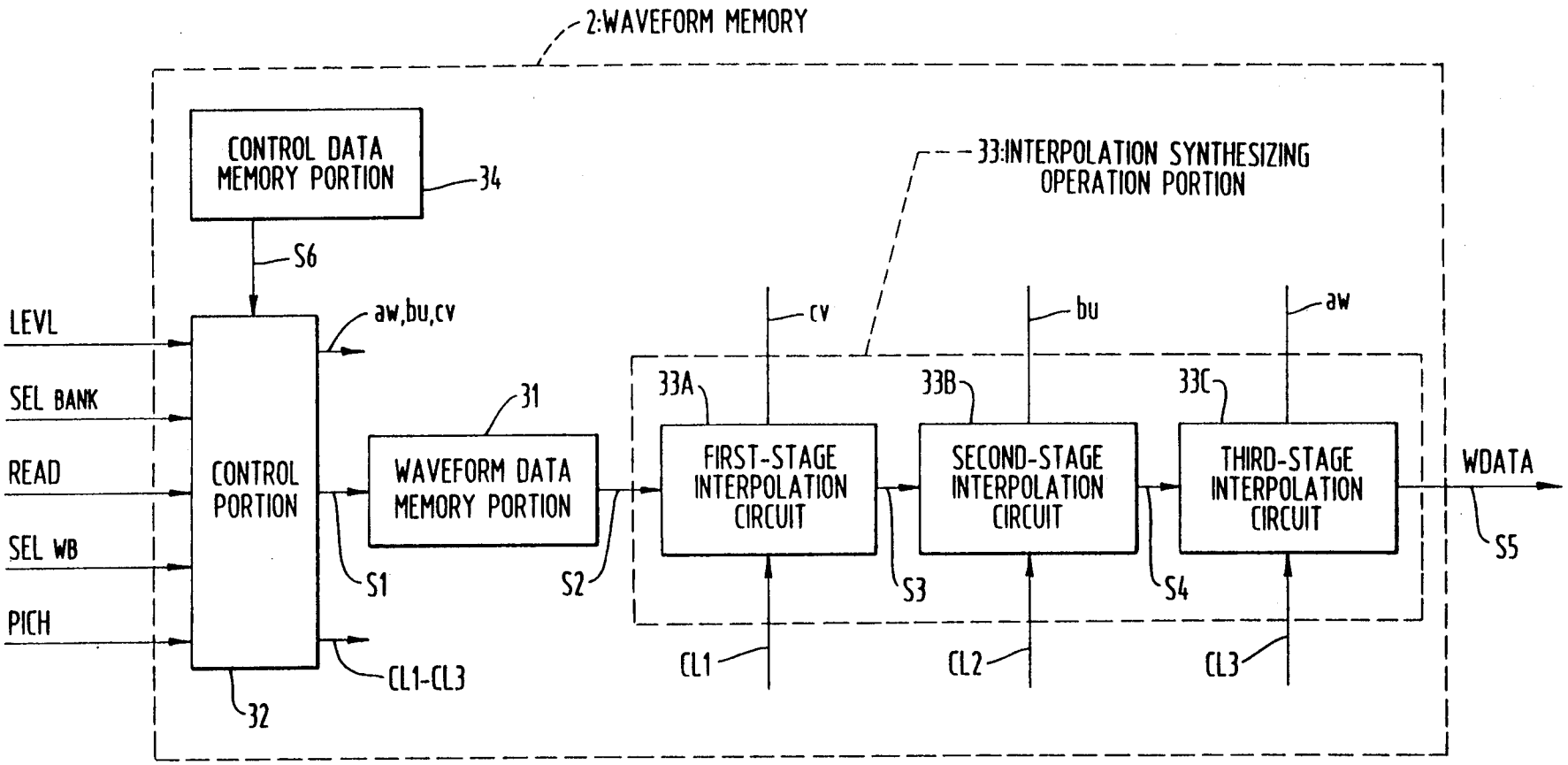
FIG. 14 is a block diagram showing the detailed configuration of the waveform memory shown in FIG. 1.

In FIG. 14, the waveform memory 2 provides a waveform data memory portion 31 which stores the waveform data of the waveform bank data portion [DATA] (see FIGS. 4, 5) and a control portion 32. The control portion 32 forms a read-out signal S1 which is supplied to the waveform data memory portion 31. Based on the read-out signal S1, a fundamental segment waveform data signal S2 is read from the waveform data memory portion 31 and then read signal S2 is supplied to an interpolation synthesizing operation portion 33.

The interpolation synthesizing operation portion 33 includes a first-stage interpolation circuit 33A, a second-stage interpolation circuit 33B and a third-stage interpolation circuit 33C therein. The first-stage interpolation circuit 33A receives the fundamental segment waveform data signal S2. Under control of a control signal CL1 from the control portion 32, the first-stage interpolation circuit 33A carries out the interpolation operation corresponding to the level variation in the j-coordinate-axis direction by use of the coefficient data $c_v$, thereby outputting an operation data signal S3 to the second-stage interpolation circuit 33B.

Next, under control of a control signal CL2 from the control portion 32, the second-stage interpolation circuit 33B carries out the interpolation operation corresponding to the pitch variation in the i-coordinate-axis direction by use of the coefficient data $b_u$, thereby outputting an operation data signal S4 to the third-stage interpolation circuit 33C.

Further, under control of a control signal CL3 from the control portion 32, the third-stage interpolation circuit 33C carries out the interpolation operation corresponding to the key code signal in the k-coordinate-axis direction by use of the coefficient data $a_w$, thereby outputting an operation data signal S5 to the envelope applying circuit 25 (see FIG. 1) as the musical tone waveform signal WDATA.

As described before in conjunction with FIG. 1, the control portion 32 receives the bank group selecting signal $SEL_{BANK}$, waveform bank selecting signal $SEL_{WB}$, pitch designating signal PICH and level designating signal LEVL as the waveform reading conditions, and the control portion 32 also receives the waveform reading signal READ as the timing signal of reading the sampling data.

In the present embodiment, data in the selecting condition data file management data portion [FILE] and waveform bank address converting table data portion [TABLE] (see FIG. 7) are stored in a control data memory portion 34 as control data S6. The control portion 32 reads out the control data S6 in response to the designated control condition to thereby form the read-out signal S1 to be supplied to the waveform data memory portion 31. In addition, the control portion 32 also forms the control signals CL1, CL2, CL3 and coefficient data $b_u$, $c_v$, $a_w$ to be supplied to the interpolation circuits 33A, 33B, 33C respectively.

Thus, under control of the control portion 32, the fundamental segment waveform data $f_{ijk}$ to $f_{(i+1)(j+1)(k+1)}$ are sequentially read from the waveform data memory portion 31 in form of the fundamental segment waveform data signal S2, wherein $f_{ijk}$ to $f_{(i+1)(j+1)(k+1)}$ are required when carrying out the interpolation operation on the synthesized waveform signal $F_{uvw}(\omega t)$ which is described in the foregoing formula (14). In synchronism with the reading of $f_{ijk}$ etc., the control portion 32 sends the coefficient data $c_v$, $b_u$, $a_w$ to the interpolation circuits 33A, 33B, 33C respectively. Thus, the interpolation synthesizing operation portion 33 forms and outputs the operation data signal S3 corresponding to the synthesized waveform signal $F_{uvw}(\omega t)$ described in the foregoing formula (14).

Figure 15:
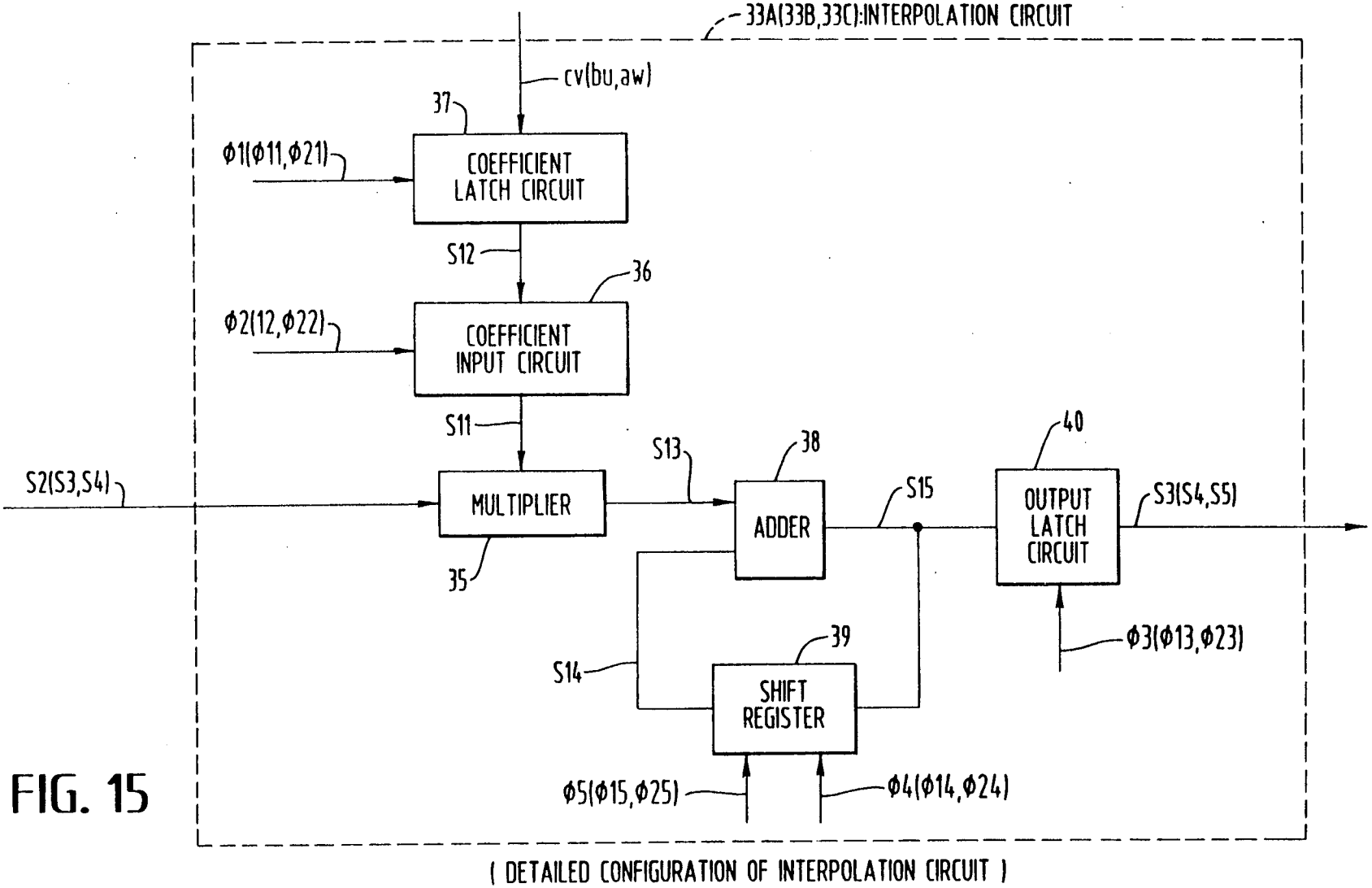
FIG. 15 is a block diagram showing the detailed configuration of an interpolation circuit, shown in FIG. 14.

All of the interpolation circuits 33A, 33B, 33C have the same configuration as shown in FIG. 15. More specifically, in the first-stage interpolation circuit 33A shown in FIG. 15, the fundamental segment waveform data signal S2 is supplied to a multiplier 35, wherein the signal S2 is multiplied by a coefficient signal S11 supplied from a coefficient input circuit 36. Meanwhile, a coefficient latch circuit 37 latches the coefficient data $c_v$ by a latch signal $\phi_1$, thereby outputting a latch output signal S12. This latch output signal S12 is supplied to the coefficient input circuit 36. In response to a complement/non-complement selecting signal $\phi_2$, the coefficient input circuit 36 forms the coefficient signal S11 the contents of which correspond to the complement or noncomplement of the latch output signal S12.

In the present embodiment, when the complement/-noncomplement selecting signal $\phi_2$ is at "0" level, the coefficient input circuit 36 forms complement $(1-c_v)$ of $c_v$ based on the latch output signal S12 (i.e., coefficient data $c_v$). Then, such complement $(1-c_v)$ is supplied to the multiplier 35 as the coefficient signal S11. On the other hand, when the complement/non-complement selecting signal $\phi_2$ is at "1" level, the coefficient input circuit 36 directly supplies the coefficient data $c_v$ to the multiplier 35 as the coefficient signal S11.

Thereafter, a multiplication output signal S13 from the multiplier 35 is supplied to an adder 38 wherein S13 is added with a shift output signal S14 from a shift register 39. Then, an addition output signal S15 from the adder 38 is supplied to both of an output latch circuit 40 and the shift register 39.

When supplied with a latch signal $\phi_3$, the output latch circuit 40 latches the addition output signal S15 and then outputs this signal S15 as the interpolated output signal S3. Such interpolated output signal S3 from the first-stage interpolation circuit 33A is to be supplied to the second-stage interpolation circuit 33B as shown in FIG. 14.

When supplied with a load signal $\phi_4$, the shift register 39 temporarily stores the addition output signal S15. Then, due to a shift pulse signal $\phi_5$, the shift register 39 sequentially outputs the stored addition output signal S15 to the adder 38 as the shift output signal S14.

As described in conjunction with FIGS. 12, 13, the fundamental segment waveform data signal S2 from the waveform data memory portion 31 is formed by eight fundamental segment waveform data $f_{ijk}$ to $f_{(i+1)(j+1)(k+1)}$ read from respective eight coordinate addresses (i, j, k) to (i+1, j+1, k+1) surrounding the interpolated address corresponding to the pitch variation and level variation based on the key code of the musical tone on which the interpolation operation is to be carried out. As described before with FIG. 13, each of eight fundamental segment waveform data consists of No.0 to No.1023 sampling data. In the first-stage interpolation circuit 33A, each of No.0-No.1023 sampling data is subject to the interpolation operation by the multiplier 35, adder 38, output latch circuit 40 and shift register 39.

Both of the second-stage interpolation circuit 33B and third-stage interpolation circuit 33C are constructed similar to the first-stage interpolation circuit 33A as described above. In the interpolation circuit 33B (or 33C), the waveform data signal S3 (or S4) is supplied to the multiplier 35; a latch signal $\phi_{11}$ (or $\phi_{21}$) is supplied to the coefficient latch circuit 37 so that the coefficient latch circuit 37 latches the coefficient data $b_u$ (or $a_w$); and a complement/non-complement selecting signal $\phi_{12}$ (or $\phi_{22}$) is supplied to the coefficient input circuit 36. Therefore, the multiplier 35 multiplies the waveform data signal S3 (or S4) by the coefficient data $b_u$ (or $a_w$) or its complement to thereby obtain the multiplication output signal S13, which is supplied to the adder 38. Thereafter, the addition output signal S15 from the adder 38 is latched in the output latch circuit 40 by a latch signal $\phi_{13}$ (or $\phi_{23}$), so that an interpolated output signal S4 (or S5) is formed. Meanwhile, the addition output signal S15 is stored in the shift register 39 by a load signal $\phi_{14}$ (or $\phi_{24}$) Then, by a shift pulse signal $\phi_{15}$ (or $\phi_{25}$), the shift register 39 outputs its stored signal to the adder 38 as the shift output signal S14.

Incidentally, the control signals CL1, CL2, CL3 respectively correspond to the above-mentioned signals ($\phi_1$ to $\phi_5$), ($\phi_{11}$ to $\phi_{15}$), ($\phi_{21}$ to $\phi_{25}$).

Under control of the control portion 32 in the waveform memory 2, the interpolation circuits 33A, 33B, 33C carry out the interpolation operations in synchronism with each other in each of operation periods SY1, SY2, . . . each having processing periods $T_0$ to $T_{11}$ as shown in FIGS. 16A and 16B. In short, in each operation period, the control portion 32 carries out the operation of the synthesized waveform signal $F_{uvw}(\omega t)$ as described in the foregoing formula (14).

Herein, each of the processing periods $T_0$ to $T_{11}$ is set at the time which is required to process the sampling data of one , waveform as shown by the fundamental segment waveform $D_{REF}$ (see FIG. 3). For example, each processing period is set at the period corresponding to a frequency of 50 kHz. In other words, each operation period such as SY1, SY2, . . . corresponds to a frequency of 600 kHz.

In the processing period $T_0$ within the operation period SY1 shown in FIGS. 16A and 16B, the control portion 32 controls the first-stage interpolation circuit 33A such that the coefficient data $c_v$ is latched in the coefficient latch circuit 37 and the shift register 39 is cleared.

At this timing, the complement/non-complement selecting signal $\phi_2$ at "0" level is supplied to the coefficient input circuit 36 in the first-stage interpolation circuit 33A. Thus, the coefficient input circuit 36 is set at the non-complement selecting state, whereby the coefficient data $c_v$ is supplied to the multiplier 35 as the coefficient signal S11. Hence, the first-stage interpolation circuit 33A is initially set at the operational processing start state.

Then, in next processing period $T_1$, under control of the control portion 32, the fundamental segment waveform data $f_{ijk}$ is read from the waveform data memory portion 31 as the fundamental segment waveform data signal S2, and then $f_{ijk}$ is supplied to the multiplier 35; the coefficient input circuit 36 is set at the complement selecting state; and the shift register 39 is activated at the load state by the load signal $\phi_4$.

As a result, the multiplication output signal S13 is passed through the adder 38 and then loaded in the shift register 39 as the addition output signal S15. Thus, the shift register holds operation data S14A1 as described in the following formula (15).

$$\mathbf{S14A1}=(1=c_v)f_{ijk} \tag{15}$$

In this processing period $T_1$, the control portion 32 also controls the second-stage interpolation circuit 33B such that the coefficient data $b_u$ is latched in the coefficient latch circuit 37 by the latch signal $\phi_{11}$ and the shift register 39 is cleared at the operation start state.

Next, under control of the control portion 32 in the processing period $T_2$, the fundamental segment waveform data $f_{i(j+1)k}$ is supplied to the multiplier 35 in the first-stage interpolation circuit 33A in the form of the fundamental segment waveform data signal S2. In addition, the coefficient input circuit 36 is set at the non-complement selecting state by the complement/non-complement selecting signal $\phi_2$ so that the coefficient input circuit 36 directly supplies the coefficient data $c_v$ to the multiplier 35 as the coefficient signal S11. Further, the output latch circuit 40 is activated by the latch signal $\phi_3$.

At this time, the adder 38 adds the shift output signal S14 to the multiplication output signal S13, thereby forming operation data S15A1 as indicated in the following formula (16). Then, the operation data S15A1 is latched by the output latch circuit 40 as the addition output signal S15.

$$\mathbf{S15A1}=(1=C_v)f_{ijk}+c_vf_{i(j+1)k} \tag{16}$$

Thus, the first interpolation circuit 33A supplies the above-mentioned operation data S15A1 as described in the formula (16) to the second-stage interpolation circuit 33B as the interpolated output signal S3.

In addition to the above-mentioned operations, the control portion 32 further controls the third-stage interpolation circuit 33C in the current processing period $T_2$ such that the coefficient data $a_w$ is latched in the coefficient latch circuit 37 and the shift register 39 is cleared at the initial state where the interpolation operation can be started.

In next processing period T3, the control portion 32 controls the second-stage interpolation circuit 33B such that the coefficient input circuit 36 is set at the complement selecting state where the complement $(1-b_u)$ of the coefficient data $b_u$ is outputted as the coefficient signal S11. In addition, the shift register 39 is set at the load state. At this time, the operation data S15A1 as described in the formula (16) is supplied to the multiplier 35 in the second-stage interpolation circuit 33B. Therefore, the multiplication output signal S13 represents the multiplication result of multiplying S15A1 by $(1-b_u)$. Thus, the adder 38 outputs the addition output signal S15 to the shift register 39, wherein S15 is equal to the operation data S14B1 as indicated by the following formula (17).

$$\mathbf{S14B1}=(1-b_u)(1-c_v)f_{ijk}+(1-b_u)c_vf_{i(j+1)k} \tag{17}$$

At the same time, the control portion 32 also controls the first-stage interpolation circuit 33A such that the shift register 39 is cleared at the state where the shift register 39 waits to receive new fundamental segment waveform data signal S2.

In next processing period $T_4$, the control portion 32 controls the first-stage interpolation circuit 33A such that the fundamental segment waveform data $f_{(i+1)jk}$ is inputted into the multiplier 35 as new fundamental segment waveform data signal S2. In addition, under control of the control portion 32, the coefficient input circuit 36 is changed over to the complement selecting state and the shift register 39 is set at the load state.

As a result, the multiplication output signal S13, i.e., operation data S14A2 as indicated in the following formula (18) is supplied to and held in the shift register 39 via the adder 38.

$$\mathbf{S14A2}=(1-c_v)f_{(i+1)jk} \tag{18}$$

In next processing period $T_5$, the control portion 32 controls the first-stage interpolation circuit 33A such that the fundamental segment waveform data $f_{(i+1)(j+1)k}$ is supplied to the multiplier 35 as a new fundamental segment waveform data signal S2 the coefficient input circuit 3 is set at the noncomplement selecting state and the output latch circuit 40 is set at the latch state.

In this period, the adder 38 forms operation data S15A2 as indicated in the following formula (19) based on the operation data S14A2 as indicated in the foregoing formula (18).

$$\mathbf{S15A2}=(1-c_v)f_{(i+1)jk}+c_vf_{(i+1)(j+1)k} \tag{19}$$

The output latch circuit 40 latches and then outputs this operation data S15A2 to the second-stage interpolation circuit 33B as the interpolated output signal S3.

In next processing period $T_6$, the control portion 32 controls the second-stage interpolation circuit 33B such that the coefficient input circuit 36 is changed over at the noncomplement selecting state and the output latch circuit 40 is set at the latch state. In this case, the shift register is loaded and holds the operation data S14B1 (see formula (17)) in the foregoing processing period $T_3$. Therefore, the adder 38 adds this operation data S14B1 to the multiplication output signal S13 to thereby form operation data S15B1 as indicated in the following formula (20).

$$\begin{aligned} S15B1 = {} & (1-b_u)(1-c_v)f_{ijk} + \\ & (1-b_u)c_vf_{i(j+1)k} + \\ & b_u(1-c_v)f_{(i+1)jk} + \\ & b_uc_vf_{(i+1)(j+1)k} \end{aligned} \tag{20}$$

The above-mentioned operation data S15B1 is latched in the output latch circuit 40.

Under control of the control portion 32 in the current processing period $T_6$, the shift register 39 in the first-stage interpolation circuit 33A is cleared at the state where a new interpolation operation can be carried out.

In next processing period $T_7$, the control portion 32 changes over the logical level of the complement/non-complement selecting signal $\phi_{22}$ from "1" to "0" so that the coefficient input circuit 36 is set at the complement selecting state. In addition, the shift register 39 is activated at the load state by the load signal $\phi_{24}$.

At this time, the multiplier 35 in the third-stage interpolation circuit 33C is supplied with the operation data S15B1 (see formula (20)) which was latched in the output latch circuit 40 in the second-stage interpolation circuit 33B in the foregoing processing period $T_6$. Thus, the shift register 39 in the third-stage interpolation circuit 33C holds operation data S14C1 as indicated in the following formula (21).

$$\begin{aligned} S14C1 = {} & (1-a_w)(1-b_u)(1-c_v)f_{ijk} + \\ & (1-a_w)(1-b_u)c_v f_{i(j+1)k} + \\ & (1-a_w)\,b_u(1-c_v)f_{(i+1)jk} + \\ & (1-a_w)\,b_u c_v f_{(i+1)(j+1)k} \end{aligned} \tag{21}$$

In addition, the control portion 32 also controls the first-stage interpolation circuit 33A in the current processing period $T_7$ such that the fundamental segment waveform data $f_{ij(k+1)}$ is supplied to the multiplier 35 as new fundamental segment waveform data signal S2, the coefficient input circuit 6 is set at the complement selecting state and the shift register 39 is activated at the load state.

As a result, the shift register 39 holds operation data S14A3 as indicated in the following formula (22).

$$\mathbf{S14A3} = (1-c_v)f_{ij(k+1)} \tag{22}$$

Further, the control portion 32 controls the second-stage interpolation circuit 33B in the current processing period $T_7$ such that the shift register 39 is cleared at the state where its operation can be started.

In next processing period $T_8$, under control of the control portion 32, the fundamental segment waveform data $f_{i(j+1)(k+1)}$ is supplied to the multiplier 35 in the first-stage interpolation circuit 33A as new fundamental segment waveform data signal S2. In addition, the coefficient input circuit 36 is set at the non-complement selecting state, and the output latch circuit 40 is activated at the latch state.

As a result, the output latch circuit 42 in the first-stage interpolation circuit 33A latches operation data S15A3 as indicated in the following formula (23), and then this operation data S15A3 is supplied to the second-stage interpolation circuit 33B.

$$\mathbf{S15A3} = (1-c_v)f_{ij(k+1)} + c_v f_{i(j+1)(k+1)} \tag{23}$$

In next processing period $T_9$, the control portion 32 controls the first-stage interpolation circuit 33A such that the shift register 39 is cleared at the state where its new operation can be started.

In next processing period $T_{10}$, the control portion 32 controls the first-stage interpolation circuit 33A such that the fundamental segment waveform data $f_{(i+1)j(k+1)}$ is supplied to the multiplier 35 as new fundamental segment waveform data signal S2, the coefficient input circuit 36 is set at the complement selecting state and the shift register 39 is set at the load state.

As a result, the shift register 39 holds operation data S14A4 as indicated in the following formula (25).

$$\mathbf{S14A4} = (1-c_v)f_{(i+1)j(k+1)} \tag{25}$$

In next processing period $T_{11}$, the control portion 32 controls the first-stage interpolation circuit 33A such that the fundamental segment waveform data $f_{(i+1)(j+1)(k+1)}$ is supplied to the multiplier 35 as new fundamental segment waveform data signal S2, the coefficient input circuit 36 is set at the non-complement selecting state and the output latch circuit 40 is set at the latch state.

As a result, the output latch circuit 40 latches operation data S15A4 as indicated in the following formula (26) including the operation data held in the shift register 39 (see formula (25)).

$$\mathbf{S15A4} = (1-c_v)f_{(i+1)j(k+1)} + c_v f_{(i+1)(j+1)(k+1)} \tag{26}$$

This operation data S15A4 is supplied to the second-stage interpolation circuit 33B.

As described heretofore, the first operation period SY1 is completed, and then the control portion 32 enters into the second operation period SY2. In processing periods $T_0$, $T_1$ of the second operation period SY2, the second-stage interpolation circuit 33B and third-stage interpolation circuit 33C continue to carry out the interpolation operations on the fundamental segment waveform data which is read from the waveform data memory portion 31 in the first operation period SY1.

More specifically, in first processing period $T_0$ of the second operation period SY2, the control portion 32 controls the second-stage interpolation circuit 33B such that the coefficient input circuit 36 is set at the non-complement selecting state and the output latch circuit 40 is set at the latch state. Thus, by use of the operation data S15A4 (see formula (26)) supplied to the output latch circuit 40 in the first-stage interpolation circuit 33A, the output latch circuit in the second-stage interpolation circuit 33B holds operation data S15B2 as indicated in the following formula (27).

$$\begin{aligned} S15B2 = {} & (1-b_u)(1-c_v)f_{ij(k+1)} + \\ & (1-b_u)c_v f_{i(j+1)(k+1)} + \\ & b_u(1-c_v)f_{(i+1)j(k+1)} + \\ & b_u c_v f_{(i+1)(j+1)(k+1)} \end{aligned} \tag{27}$$

In next processing period $T_1$ of the second operation period SY2, the control portion 32 controls the third-stage interpolation circuit 33C such that the coefficient input circuit 36 is set at the non-complement selecting state and the output latch circuit 40 is set at the latch state. Thus, the output latch circuit 40 of the third-stage interpolation circuit 33C latches operation data S15C1 as indicated in the following formula (28) including the operation data S14C1 (see formula (21)) held in the shift register 39.

$$\begin{aligned} S15C1 = {} & (1-a_w)(1-b_u)(1-c_v)f_{ijk} + \\ & (1-a_w)(1-b_u)c_v f_{i(j+1)k} + \\ & (1-a_w)b_u(1-c_v)f_{(i+1)jk} + \\ & (1-a_w)b_u c_v f_{(i+1)(j+1)k} + \\ & a_w(1-b_u)(1-c_v)f_{ij(k+1)} + \\ & a_w(1-b_u)c_v f_{i(j+1)(k+1)} + \\ & a_w b_u(1-c_v)f_{(i+1)j(k+1)} + \\ & a_w b_u c_v f_{(i+1)(j+1)(k+1)} \end{aligned} \tag{28}$$

Such operation data is outputted from the third-stage interpolation circuit 33C as the interpolated waveform data signal S5.

When comparing this formula (28) to the foregoing formula (14), it is obvious that the interpolated waveform data signal S5 has the same contents of the synthesized waveform signal $F_{uvw}(\omega t)$. Based on this signal S5, it is possible to obtain the musical tone waveform signal WDATA of the waveform memory 2.

(6) Modified Example of Waveform Memory 2

Figure 17:
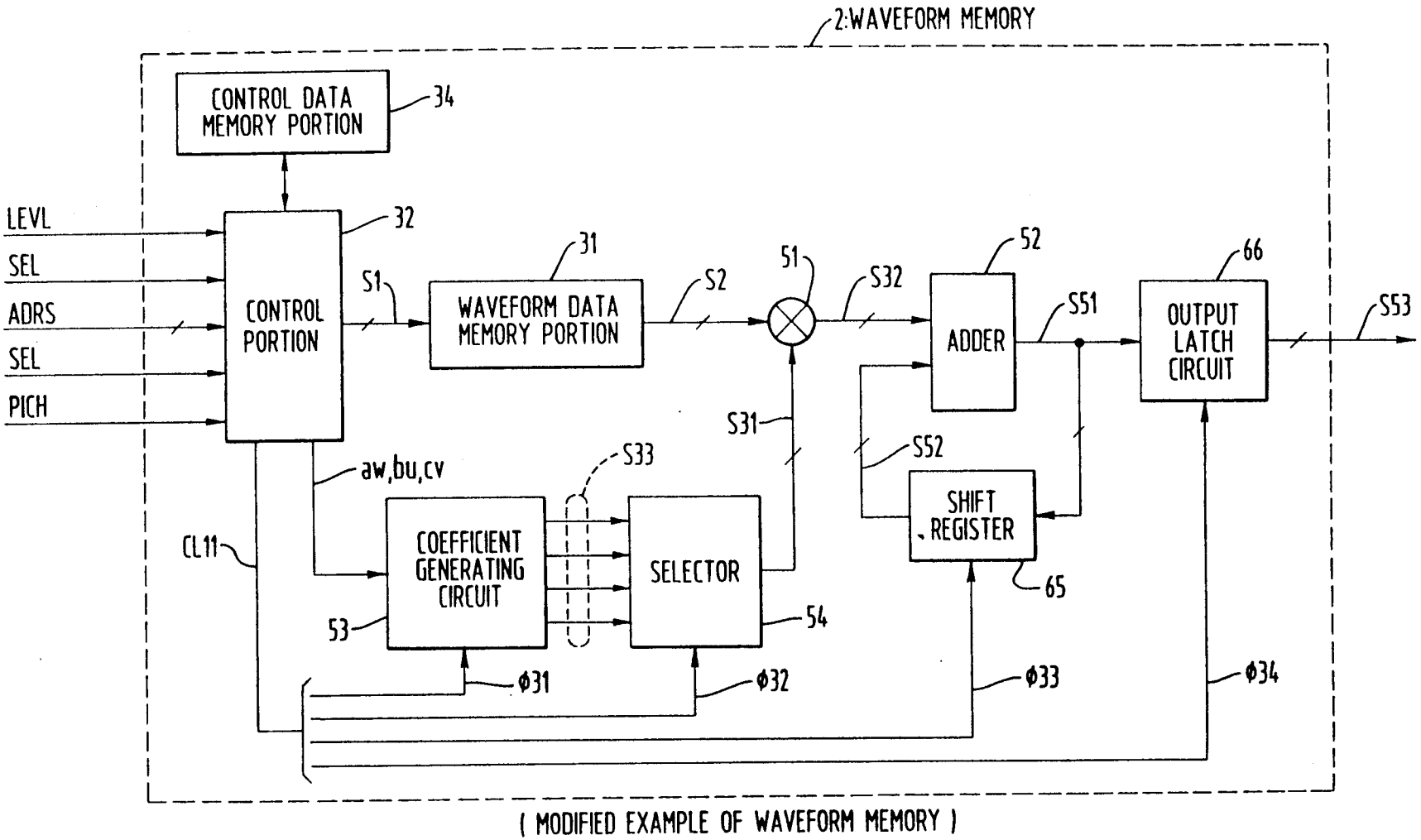
FIG. 17 is a block diagram showing the detailed configuration of the waveform memory according to a modified example of the first embodiment.

FIG. 17 shows the configuration of the waveform memory 2 according to a modified example of the first embodiment, wherein parts identical to those shown in FIG. 14 are designated by the same numerals and description thereof will be omitted. In FIG. 17, based on the reading signal S1, the fundamental segment waveform data $f_{ijk}$ to $f_{(i+1)(j+1)(k+1)}$ which are used to synthesize the waveform data $F_{uvw}(\omega t)$ in the foregoing formula (14) are sequentially read from the waveform data memory portion 31 in operation periods SY11, SY12, . . . each having processing periods $T_{20}$ to $T_{27}$ as shown in FIG. 19. Then, a multiplier 51 multiplies the read fundamental segment waveform signal S2 by a coefficient data signal S31 to thereby form a multiplication output signal S32, which is supplied to an adder 52.

The control portion 32 supplies the coefficient data $a_w$, $b_u$, $c_v$ to a coefficient generating circuit 53, wherein coefficient signals S33 are generated. The coefficient signal S33 corresponds to a coefficient part in each term of the formula (14). Then, a selector 54 selects and outputs one of the coefficient signals S33 as the coefficient data signal S31.

Figure 18:
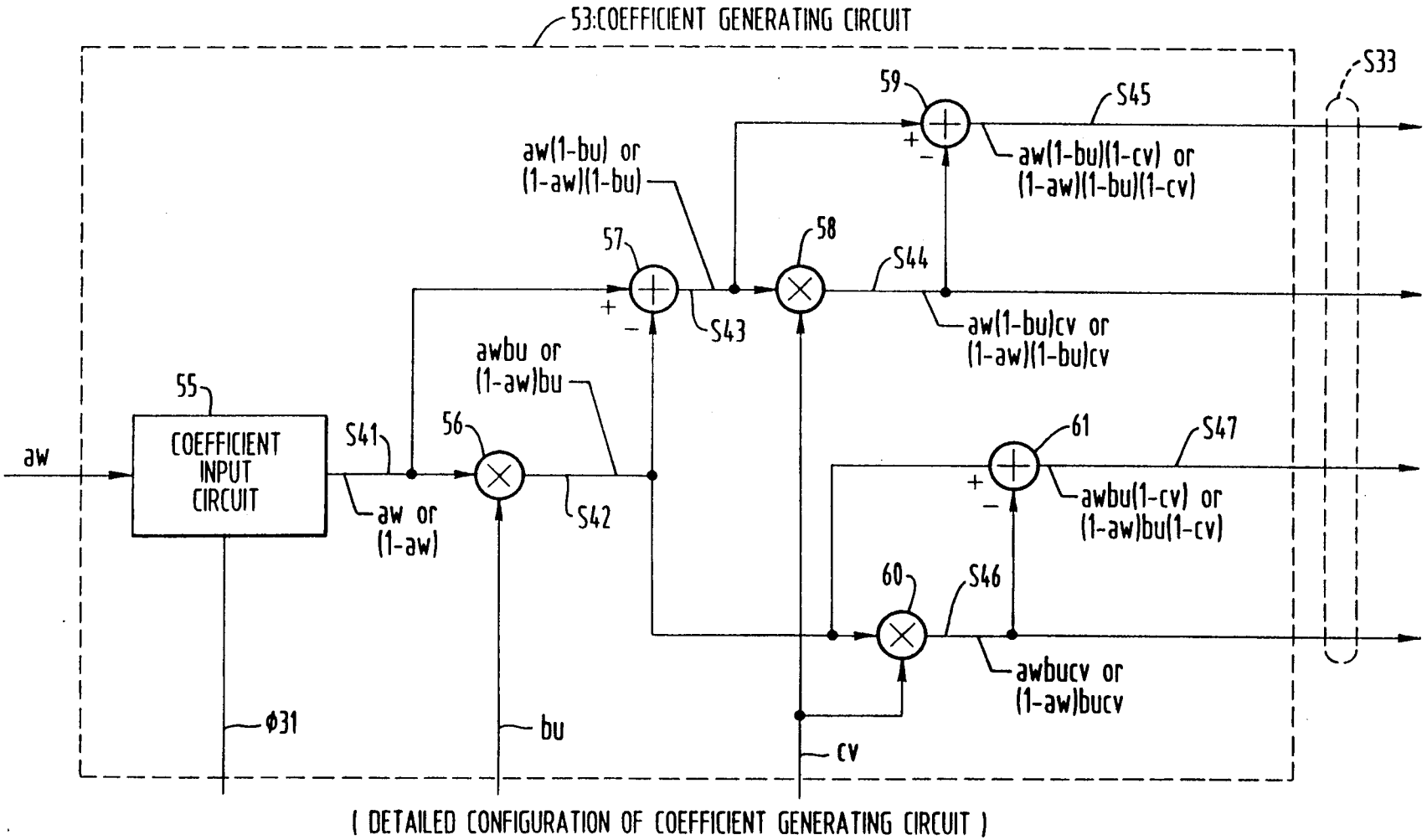
FIG. 18 is a block diagram showing the detailed configuration of a coefficient generating circuit shown in FIG. 17.

Herein, the coefficient generating circuit 53 is constructed as shown in FIG. 18. In FIG. 18, the coefficient data $a_w$ is supplied to a coefficient input circuit 55. In response to a complement/non-complement selecting signal $\phi_{31}$ which is transmitted from the control portion (see FIG. 17) as a part of its control signal CL11, the coefficient input circuit 55 is subject to the complement or non-complement selecting state. More specifically, the coefficient input circuit 55 outputs the coefficient data $a_w$ when it is in the noncomplement selecting state, while the coefficient input circuit 55 outputs the complement $(1-a_w)$ when it is in the complement selecting state. Such output data of the coefficient input circuit 55 is transmitted as a coefficient selecting signal S41.

The coefficient selecting signal S41 is supplied to a multiplier 56 wherein S41 is multiplied by the coefficient data $b_u$. Thus, the multiplier 56 outputs a multiplication output signal S42, the contents of which is $a_w b_u$ or $(1-a_w)b_u$.

The above-mentioned signals S41, S42 are supplied to a subtractor 57 wherein S42 is subtracted from S41. Therefore, the subtractor 57 forms a subtraction output signal S43, the contents of which contents is $a_w(1-b_u)$ or $(1-a_w)(1-b_u)$.

The subtraction output signal S43 is multiplied by the coefficient data $c_v$ in a multiplier 58, which therefore forms a multiplication output signal S44, the contents of which is $a_w(1-b_u)c_v$ or $(1-a_w)(1-b_u)c_v$ The signals S43, S44 are supplied to a subtractor 59 wherein S44 is subtracted from S43. Therefore, the subtractor 59 forms a subtraction output signal S45, the contents of which is $a_w(1-b_u)(1-c_v)$ or $(1-a_w)(1-b_u)(1-c_v)$.

Meanwhile, a multiplier 60 multiplies the foregoing multiplication output signal S42 from the multiplier 56 by the coefficient data $c_v$ to thereby form a multiplication output signal S46, the contents of which is $a_w b_u c_v$ or $(1-a_w)b_u c_v$.

Two multiplication output signals S42, S46 are supplied to a subtractor 61 wherein S46 is subtracted from S42. Therefore, the subtractor 61 forms a subtraction output signal S47, the contents of which is $a_w b_u(1-c_v)$ or $(1-a_w)b_u(1-c_v)$.

Based on the complement or non-complement selecting state of the coefficient input circuit 55 which is controlled by the complement/non-complement selecting signal $\phi_{31}$, the coefficient generating circuit 53 generates four signals S45, S44, S47, S46 as the foregoing coefficient signals S33, which are supplied to the selector 54.

In response to the coefficient selecting signal $\phi_{32}$ which is transmitted from the control portion 32 as a part of its control signal CL11, the selector 54 sequentially selects the signals S45, S44, S47, S46 in the processing periods $T_{20}$, $T_{21}$, $T_{22}$, $T_{23}$. In other words, the selector 54 sequentially transmits the coefficient data $(1-a_w)(1-b_u)(1-c_v)$, $(1-a_w)(1-b_u)c_v$, $(1-a_w)b_u(1-c_v)$, $(1-a_w)b_u c_v$ as the coefficient data signal S31. Thus, the multiplier 51 can form the multiplication output signal S32 as shown in FIG. 19.

During the processing periods $T_{24}$, $T_{25}$, $T_{26}$, $T_{27}$, the coefficient input circuit 55 is set in the non-complement selecting state by the complement/non-complement selecting signal $\phi_{31}$. Therefore, the selector 54 sequentially selects the signals S45, S44, S47, S46 generated from the coefficient generating circuit 53 during these periods $T_{24}$-$T_{27}$. Thus, the selector 54 sequentially outputs the coefficient data $a_w(1-b_u)(1-c_v)$, $a_w(1-b_u)c_v$, $a_w b_u(1-c_v)$, $a_w b_u c_v$ as the coefficient data signal S31. Thus, the multiplier 51 can form the multiplication output signal S32 as shown in FIG. 19 during the processing periods $T_{24}$-$T_{27}$.

As described heretofore, the adder 52 sequentially receives eight kinds of the multiplication output signals S32 from the multiplier 51 in the processing periods $T_{20}$ to $T_{27}$. Then, an addition output signal S51 obtained from the adder 52 is supplied to and held in a shift register 65 by a shift control signal $\phi_{33}$ which is included in the foregoing control signal CL11. Then, the shift register 65 feeds back its shift output signal S52 to the adder 52.

Thus, the adder 52 sequentially accumulates the multiplication output signals S32 transmitted from the multiplier 51 during the processing periods $T_{20}$ to $T_{27}$ in each of the operation periods SY11, SY12, . . . , and then its accumulated signal is outputted as the addition output signal S51. Such addition output signal S51 is latched by an output latch circuit 66 by a latch control signal $\phi_{34}$.

In the present embodiment, at the last processing period $T_{27}$ in each of the operation periods SY11, SY12, . . . , the latch control signal $\phi_{34}$ activates the output latch circuit 66 and the shift control signal $\phi_{33}$ clears the shift register 65. Thus, the output latch circuit 66 can output an interpolated waveform data signal S53 representative of the accumulation result of the adder 52 in each of the operation periods SY11, SY12, . . . , i.e., the synthesized waveform signal $F_{uvw}(\omega t)$ as indicated in the foregoing formula (14). This signal S53 is outputted from the waveform memory 2 as the musical tone waveform signal WDATA.

As described heretofore, the waveform memory 2 according to the modified example of the first embodiment as shown in FIGS. 17 to 19 can also carry out the interpolation operation as similar to the waveform memory 2 according to the first embodiment as shown in FIGS. 14 to 16B.

[B] Second Embodiment

Figure 20:
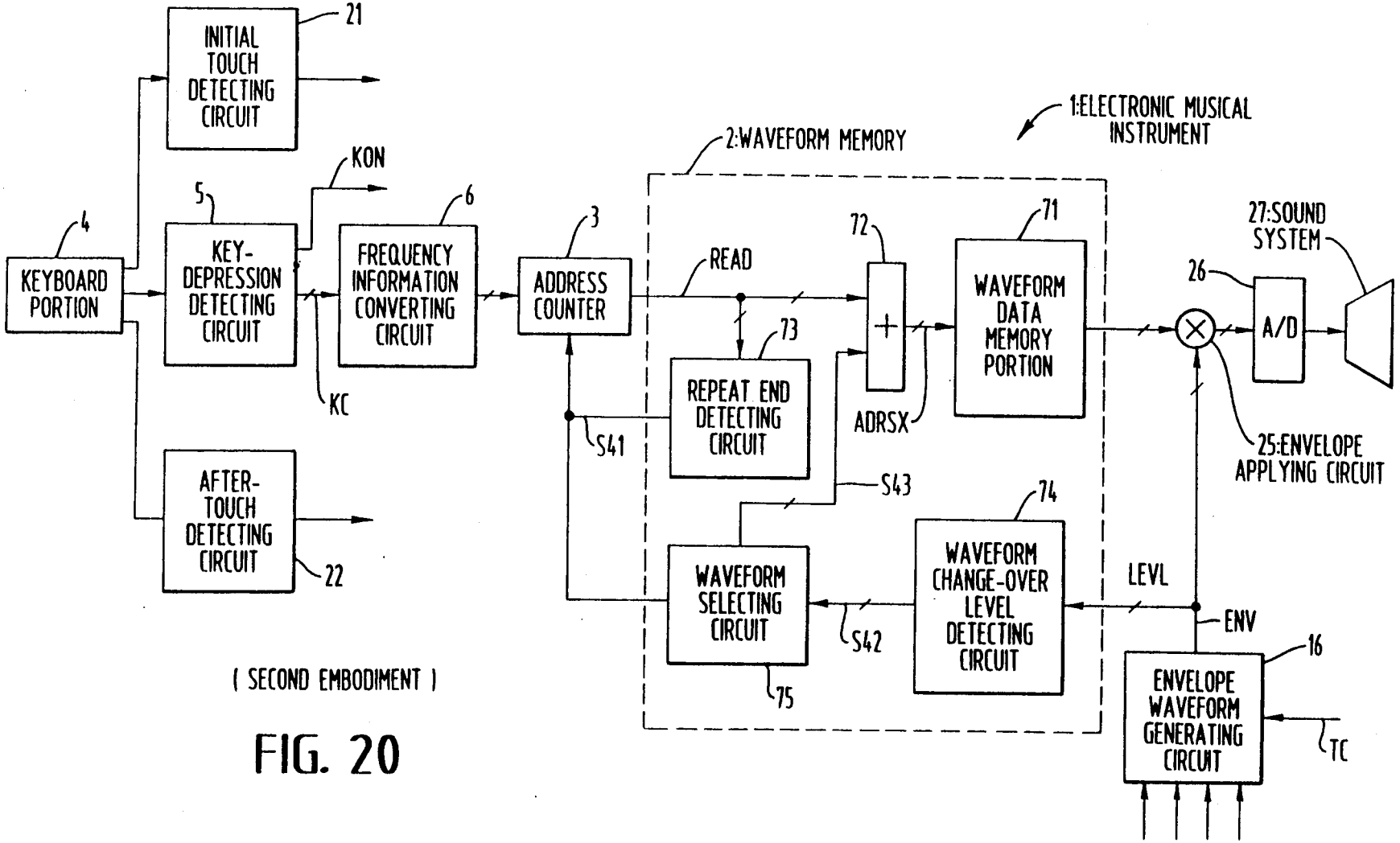
FIG. 20 is a block diagram showing an electronic musical instrument according to a second embodiment of the present invention.

Next, description will be given with respect to the second embodiment of the present invention by referring to FIGS. 20 to 23. In FIG. 20, parts identical to those shown in FIG. 1 will be designated by the same numerals, hence, description thereof will be omitted. The electronic musical instrument 1 according to the second embodiment as shown in FIG. 20 varies the tone color to follow the envelope variation of the musical tone. Notably, the second embodiment is characterized by avoiding generation of noises by smoothly connecting the fundamental segment waveforms $D_{REF}$ together.

Figure 21:
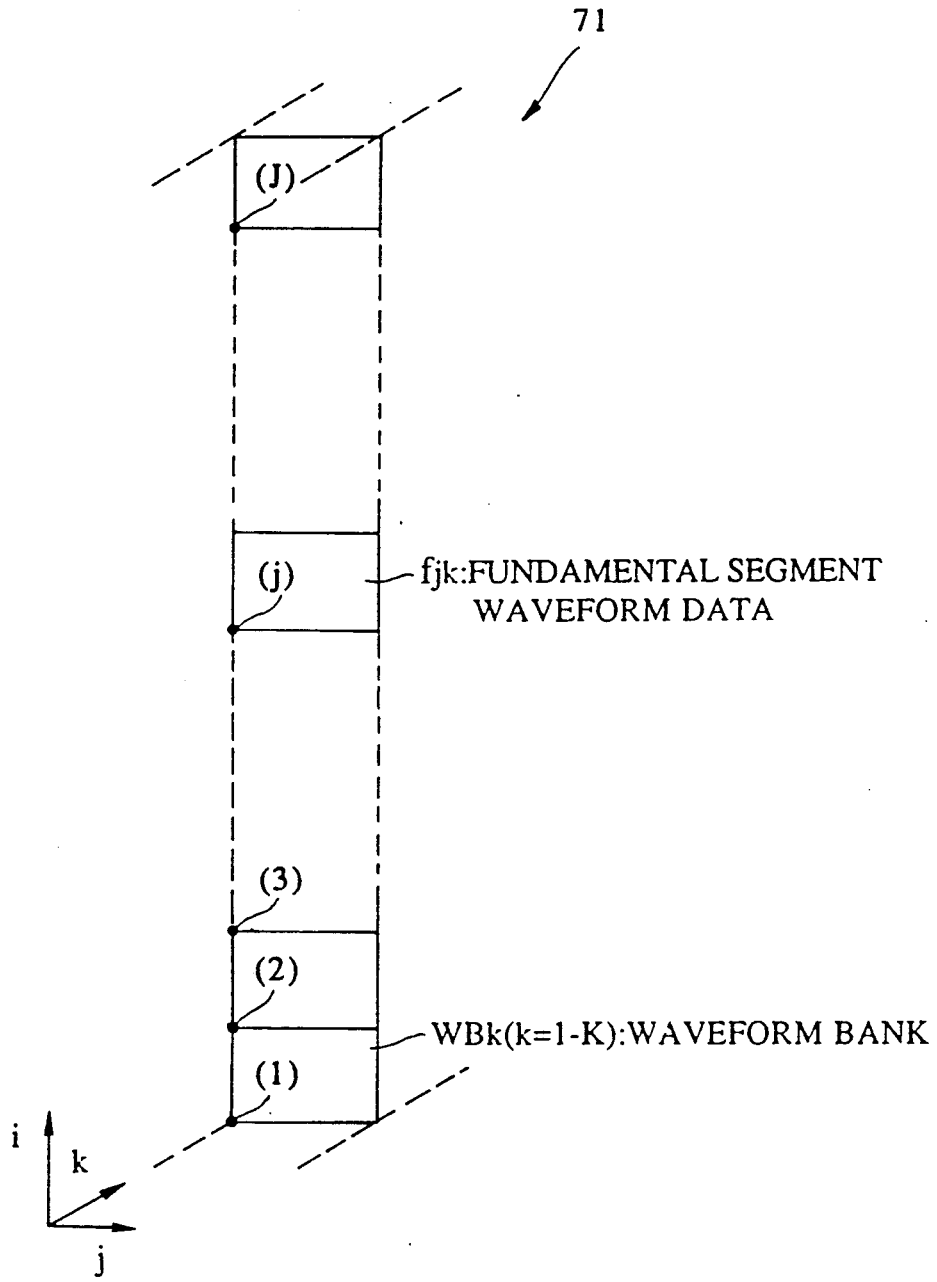
FIG. 21 is a conceptual diagram showing the waveform data memory portion shown in FIG. 20.

The waveform memory 2 of the second embodiment includes a waveform data memory portion 71 which provides plural waveform banks $WB_k$ (where k=1 to K) corresponding to the key codes as shown in FIG. 21. By designating the waveform bank number k in the k-coordinate-axis direction, it is possible to select the waveform bank $WB_k$ corresponding to the key code of the performed key.

In correspondence with the envelope variation, each waveform bank $WB_k$ stores J fundamental segment waveform data $f_{jk}$ each having each of the coordinate addresses j (where j=1 to J) in the j-coordinate-axis direction. Therefore, by changing over the coordinate address j in the j-coordinate-axis direction, it is possible to read out the fundamental segment waveform data each having the different waveform (i.e., different tone color).

Figure 22:
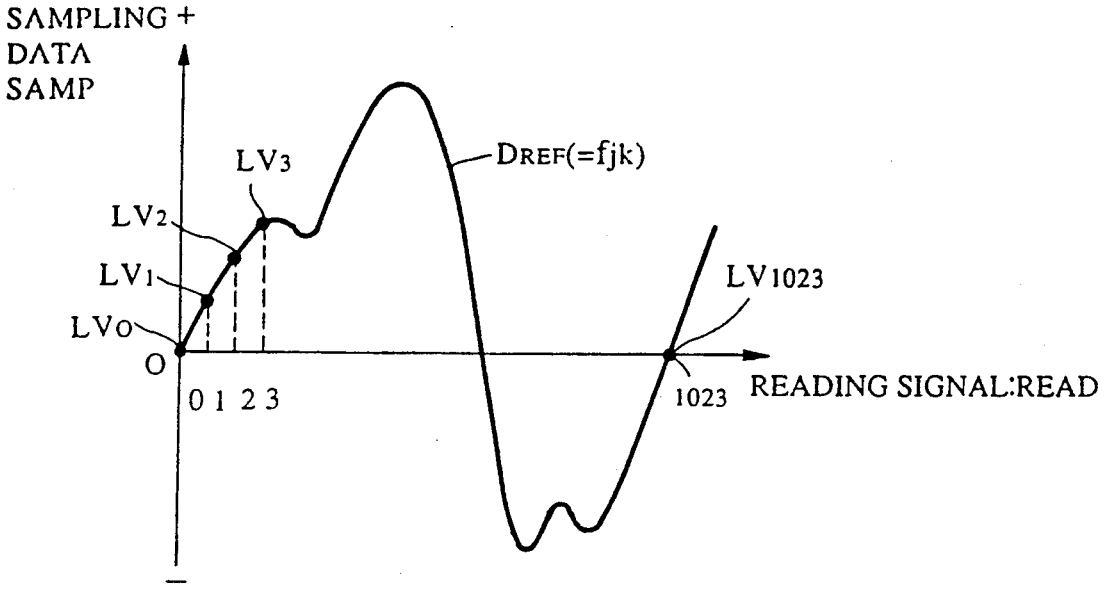
FIG. 22 shows a signal waveform of the fundamental waveform data used in the second embodiment as shown in FIG. 21.

As shown in FIG. 22, each fundamental segment waveform data $f_{jk}$ includes No.0 sampling data $LV_O$ to No.1023 sampling data $LV_{1023}$. Both of first sampling data $LV_O$ and last sampling data $LV_{1023}$ are set at the same predetermined level of the fundamental segment waveform $D_{REF}$, e.g., zero-level.

For the reason set above, first waveform data level indicative of the level of the last sampling data in certain fundamental segment waveform data can coincide with second waveform data level indicative of the level of the first sampling data in next fundamental segment waveform data. Therefore, it is possible to smoothly connect two waveforms at their connection point Meanwhile, the reading signal READ from the address counter 3 is supplied to the waveform data memory portion 71 via an adder 72, whereas READ is also supplied to a repeat end detecting circuit 73. When the contents of the reading signal READ corresponds to the last sampling number (i.e., SMP=1023), the repeat end detecting circuit 73 generates and then outputs a repeat end detecting signal S41 to an address return signal input of the address counter 3.

Thus, when the reading signal READ corresponds to the last sampling number of the fundamental segment waveform $D_{REF}$, the count value of the address counter is returned identical to a reading start address value (i.e., sampling number "0"). Therefore, by the reading signal READ which repeatedly designates the sampling numbers "0" to "1023", it is possible to repeatedly read the fundamental segment waveform data $f_{jk}$ from the waveform data memory portion 71.

In addition, the waveform memory 2 also includes a waveform change-over level detecting circuit 74 which receives an envelope signal ENV from an envelope waveform generating circuit 16 as the level designating signal LEVL.

Figure 23:
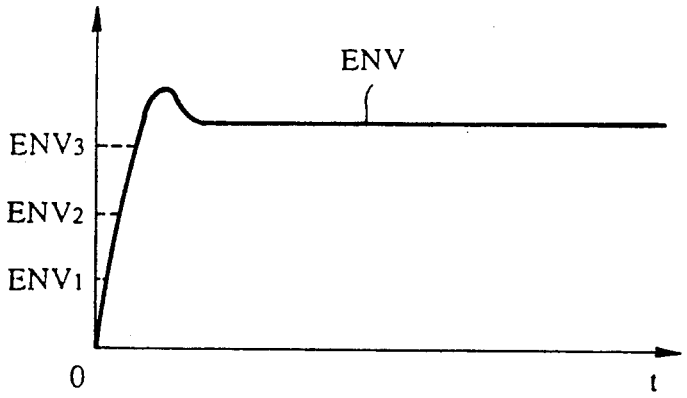
FIG. 23 shows a signal waveform used for explaining a level detecting operation of the second embodiment.

As shown in FIG. 23, the waveform change-over level detecting circuit 74 outputs a waveform change-over signal S42 to a waveform selecting circuit 75 when it is detected that the signal level of the envelope signal ENV in the attack portion reaches the predetermined signal levels, i.e., $ENV_1$, $ENV_2$, $ENV_3$.

In the state where the waveform change-over level detecting circuit 74 does not output the waveform change-over signal S42, the waveform selecting circuit 75 outputs an address shift signal S43 by which an address shift value is set at "0". Such address shift signal S43 is supplied to the adder 72. Thus, the waveform data memory portion 71 designates the address which is determined by the reading signal REA from the address counter 3 only, so that the fundamental segment waveform data $f_{lk}$ can be read from the memory area corresponding to the reference coordinate address j=1, for example.

In such state, when the envelope signal ENV from the envelope waveform generating circuit 16 exceeds the signal level $ENV_1$ shown in FIG. 23, the generated waveform change-over signal S42 activates the waveform selecting circuit 75, from which the address shift signal S43 representative of the predetermined address shift value is supplied to the adder 72.

As a result, the waveform data memory portion 71 is supplied with an address signal ADRSX indicative of the sum of the address shift signal S43 and reading signal READ. Thus, the reading state of the present system is changed over to the state where the present system is ready to read the fundamental waveform data from the memory area corresponding to the address position which is shifted by the address shift value.

In the above-mentioned state, every time the signal level of the envelope signal ENV rises up and then exceeds the change-over levels $ENV_2$, $ENV_3$, the waveform change-over signal S42 is outputted from the waveform change-over level detecting circuit 74. In response to this waveform change-over signal S42, the waveform selecting circuit 75 generates the address shift signal S43 of which address value is shifted by the predetermined shift value. Based on this address shift signal S43, the tone color of the musical tone waveform signal WDATA read from the waveform data memory portion 71 is changed over.

The waveform selecting circuit 75 receives the repeat end detecting signal S41 from the repeat end detecting circuit 73 at its change-over timing signal input. At a time when the repeat end detecting signal S41 is generated, the waveform selecting circuit 75 changes over the address shift signal S43.

Thus, in the case where the waveform change-over level detecting circuit 74 generates the waveform change-over signal S42 in the middle timing of reading the fundamental segment waveform data $f_{jk}$ of one period from the waveform data memory portion 71, the present system waits for the variation of the address shift signal S43 to be occurred until the timing when the repeat end detecting signal S41 is generated. Therefore, the waveform change-over operation in the musical tone waveform signal WDATA can be always carried out at the timing when the signal level coincides with the reference level (i.e., zero-level) of the fundamental segment waveform $D_{REF}$. After all, it is possible to form the musical tone waveform signal WDATA of which tone color can be smoothly varied.

[C] Third Embodiment

Figure 24:
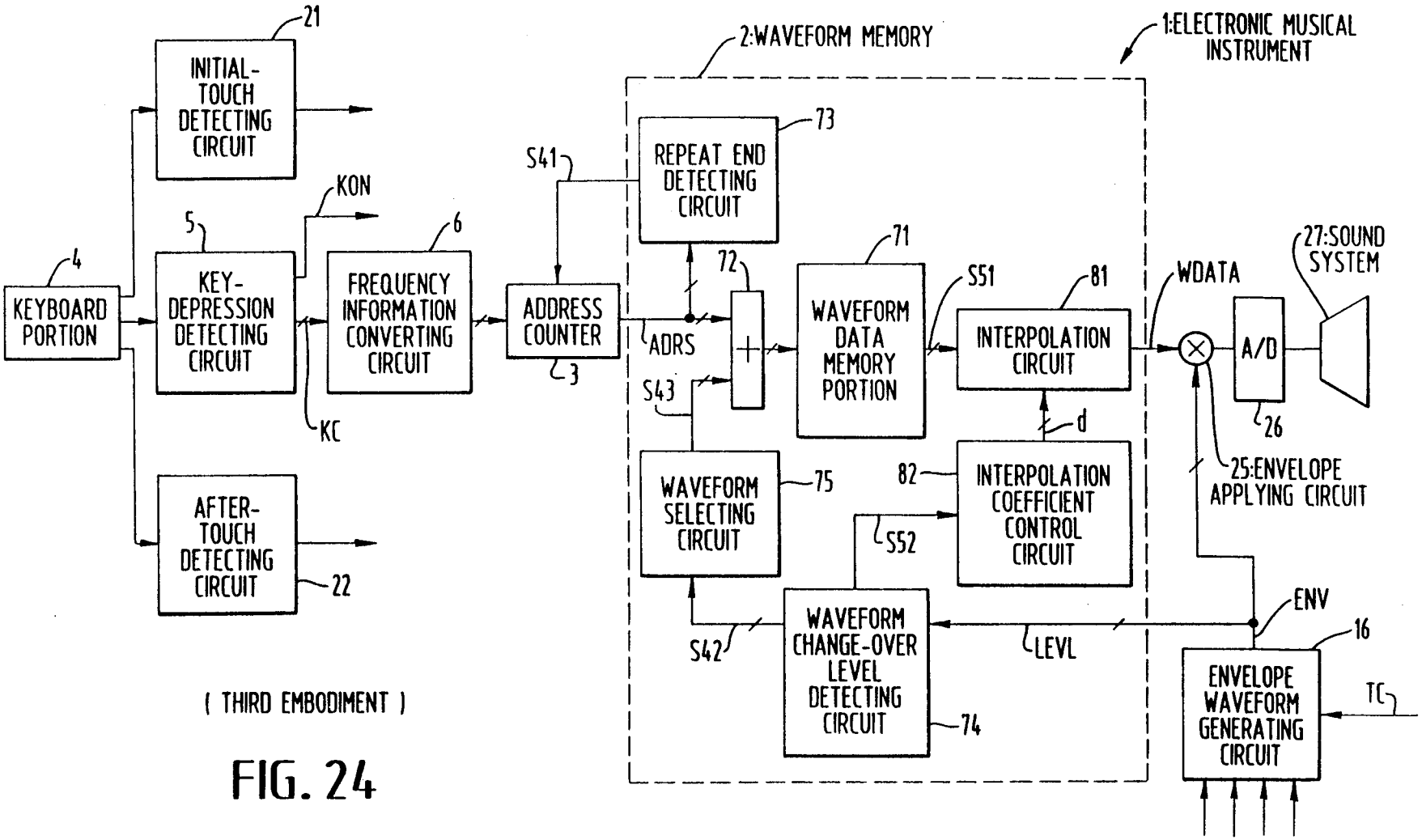
FIG. 24 is a block diagram showing an electronic musical instrument according to a third embodiment of the present invention.

FIG. 24 shows the electronic musical instrument 1 according to the fourth embodiment of the present invention, wherein parts identical to those shown in FIG. 20 are designated by the same numerals and description thereof will be omitted. This fourth embodiment can smoothly change over a certain waveform to the next waveform even if the fundamental segment waveform $D_{REF}$ is at an arbitrary signal level at the waveform change-over point.

Different from the waveform selecting circuit 75 shown in FIG. 20, the waveform selecting circuit 75 shown in FIG. 24 is designed to output the address shift signal S43 to the adder 72 immediately after receiving the waveform change-over signal S42 from the waveform change-over level detecting circuit 74.

In addition, a waveform data signal S51 is read from the waveform data memory 71 shown in FIG. 24 and then supplied to an interpolation circuit 81. Based on interpolation coefficient "d" from an interpolation coefficient control circuit 82, the interpolation circuit 81 carries out the interpolation operation on the waveform data signal S51 to thereby generate the musical tone waveform signal WDATA.

Figure 25A:
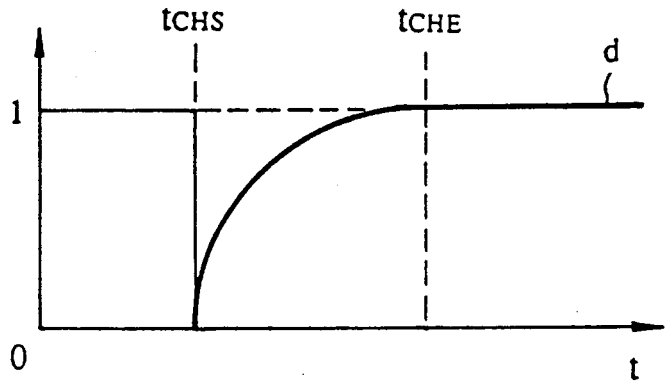
FIGS. 25A and 25B show signal waveforms used for explaining an interpolation coefficient used in the third embodiment as shown in FIG. 24.

Before the waveform change-over detecting signal S51 is obtained from the waveform change-over level detecting circuit 74 at a time $t_{CHS}$ shown in FIG. 25(A), the interpolation coefficient control circuit 82 supplies interpolation coefficient data d at "1" level to the interpolation circuit 81. At the time $t_{CHS}$ when the waveform is changed over, the interpolation coefficient control circuit 82 falls down the interpolation coefficient data d to "0". level. Then, with an elapsed time of t, the interpolation coefficient data d gradually rises up to "1" level under control of the interpolation coefficient control circuit 82. After a time $t_{CHE}$ when the interpolation coefficient data d reaches at "1" level, the interpolation coefficient data d is maintained at "1" level.

Figure 26:
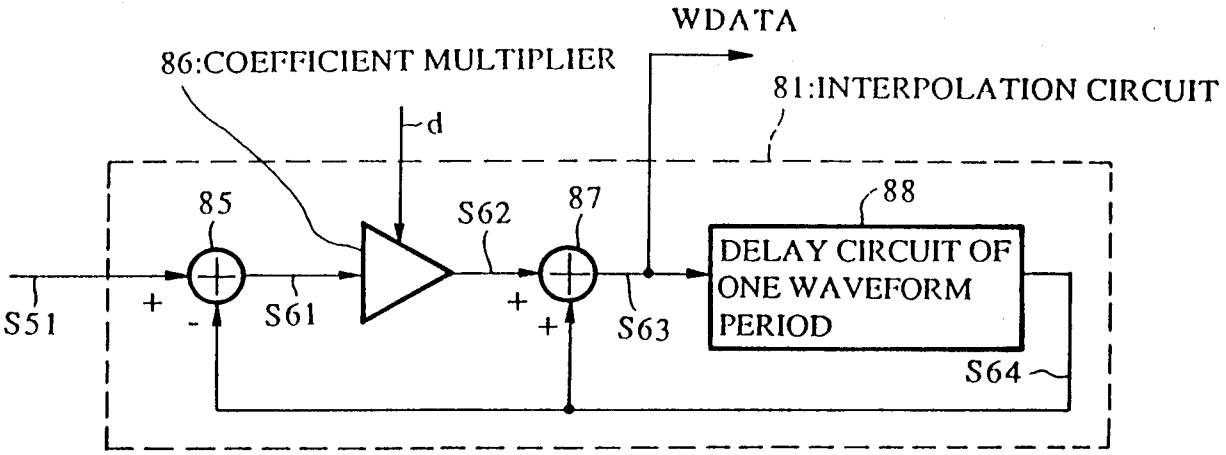
FIG. 26 is a block diagram showing the detailed configuration of an interpolation circuit shown in FIG. 24.

The interpolation circuit 81 is constructed as shown in FIG. 26. More specifically, the waveform data signal S51 is supplied to a subtractor 85 at its plus terminal. Then, the subtractor 85 outputs a subtraction output signal S61 to a coefficient multiplier 86 wherein S61 is multiplied by the interpolation coefficient data d. Thus, the coefficient multiplier 86 outputs a multiplication output signal S62 to an adder 87, from which S62 is directly outputted as an addition output signal S63 to a delay circuit 88 of one waveform period which has a delay time corresponding to one waveform period.

The delay circuit 88 is constructed by a shift register which temporarily stores the sampling data sequentially supplied thereto for one waveform period. Then, the delay circuit 88 outputs a delayed waveform data signal S64 to the subtractor 85 at its minus terminal and the adder 87.

Figure 25B:
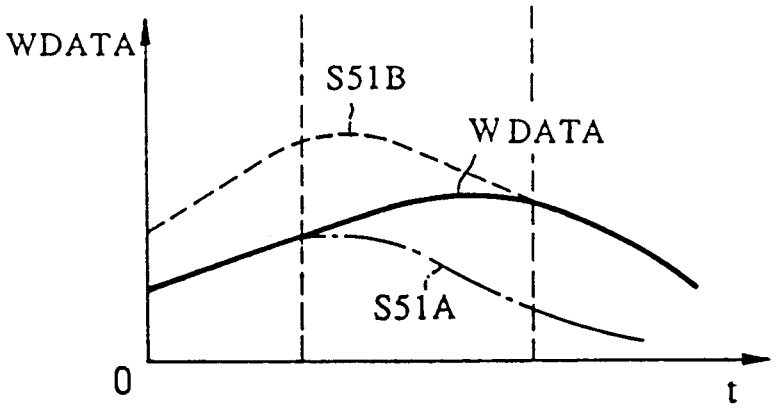

Now, before time $t_{CHS}$ shown in FIG. 25(A), the waveform data memory portion 71 outputs a first waveform data signal S51A as shown in FIG. 25(B) by the address shift signal S43 from the waveform selecting circuit 75. Then, at time $t_{CHS}$, the waveform change-over level detecting circuit 74 outputs the waveform change-over signal S42, by which the waveform selecting circuit 75 is set at the state where a second waveform data signal S51B is to be read out instead of S51A. In such case, the interpolation circuit 81 carries out the interpolation operation based on deviation between the waveform data signals S51A, S51B.

More specifically, before time $t_{CHS}$, the first waveform data signal S51A is supplied to the subtractor 85 in the interpolation circuit 81, so that this signal S51A is delayed and then outputted from the delay circuit 88 as the delayed waveform data signal S64. At this time, the subtractor 85 detects no deviation between its two input signals (i.e., S51A), because of S51A−S51A=0. Thus, the coefficient multiplier 86 multiplies the subtraction output signal S61 (at "0" level) by the interpolation coefficient data d (="1") so that the multiplication output signal S62 is equal to "0".

In this case, the delayed waveform data signal S64 is directly fed back to the delay circuit 88 via the adder 87 so that the delay circuit 88 maintains to hold the first waveform data signal S51A, which is outputted from the adder 87 as the musical tone waveform signal WDATA.

Thereafter, at time $t_{CHS}$, the input signal of the interpolation circuit 81 is changed over from S51A to S51B. At this time, the subtractor 85 outputs the subtraction output signal S61 representative of the deviation between S51A and S51B, so that S61=S51B−S51A. Such subtraction output signal S61 is multiplied by the interpolation coefficient data d in the coefficient multiplier 86. In this case, the interpolation coefficient control circuit 82 varies the interpolation coefficient data d from "0" to "1". Therefore, the multiplication output signal S62 from the coefficient multiplier 86 is controlled to be gradually increased in accordance with the equation "S62=d(S51B−S51A)". Such signal S62 is added to the first waveform data signal S51A in the adder 87.

Thereafter, when the interpolation coefficient data d reaches at "1" level at time $t_{CHE}$, the above-mentioned signal S62 reaches at (S51B−S51A), which is added to S51A in the adder 87. In short, the addition output signal S63 reaches at S51B at time $t_{CHE}$.

The above-mentioned addition output signal S63 will be outputted from the waveform memory 2 as the musical tone waveform signal WDATA, and S63 is also supplied to the delay circuit 88. After all, the second waveform data signal S51B is held in the delay circuit 88.

As described heretofore, in the case where two waveform data signals S51A, S51B each having a different waveform are read from the waveform data memory portion 71 in turn, the musical tone waveform signal WDATA is gradually and smoothly varied from S51A to S51B during the period between change-over start time $t_{CHS}$ and change-over end time $t_{CHE}$. After the change-over end time $t_{CHE}$, the second waveform data signal S51B is outputted from the waveform memory 2 as the musical tone waveform signal WDATA.

According to the second embodiment as shown in FIGS. 24 to 26, every time the envelope signal ENV exceeds the waveform change-over levels $ENV_1$, $ENV_2$, $ENV_3$ at arbitrary timings, the waveform of the musical tone waveform signal WDATA can be smoothly changed over.

[C] Modified Examples

The present invention as described in the foregoing first and second embodiments can be modified as follows.

(1) The embodiment described before utilizes the sampling data of one period. Instead, it is possible to utilize the sampling data of plural periods or other waveform data which is compressed sampling data of one period or plural periods.

Instead of the sampling data, it is possible to use parameter data indicative of the parameter which is used to synthesize frequency-modulated (FM) waveform or higher harmonic waveform. In this case, the interpolation operation is carried out on plural parameters corresponding to plural musical tone waveforms.

(2) The foregoing first embodiment as shown in FIGS. 1 to 19 carries out the interpolation operation on the fundamental waveform data stored in the waveform memory 2 to thereby form the musical tone signal. However, it is possible to re-design the first embodiment such that the fundamental waveform data is directly converted into the musical tone signal without carrying out the interpolation operation. In this case, it is possible to obtain the effects similar to those of the foregoing embodiments.

In contrast, the foregoing second embodiment as shown in FIGS. 20 to 23 and third embodiment as shown in FIGS. 24 to 26 directly convert the fundamental waveform data stored in the waveform memory 2 into the musical tone signal without carrying out the interpolation operation. However, it is possible to redesign these embodiments such that the fundamental waveform data is converted into the musical tone signal by carrying out the interpolation operation.

(3) In the foregoing embodiments, the output LEVL of the envelope waveform generating circuit 16 is controlled by the initial-touch signal INTL and after-touch signal AFTR so that the level variation is to be caused. However, it is unnecessary to control the output LEVL by the touch signal. In this case, the level variation occurs based on the envelope signal ENV only. It is also possible to cause the level variation by the touch information only.

In addition, it is possible to control the level designating signal LEVL by outputs of operators such as the expression, breath controller, modulation wheel etc. which can be operated in the middle of the performance by the performer.

(4) In the foregoing embodiments, the fundamental waveform data read from the waveform memory 2 is changed over when the level designating signal LEVL or pitch designating signal PICH exceeds the predetermined change-over signal level. In this case, it is possible to vary such change-over signal level with an lapse of time.

Figure 27:
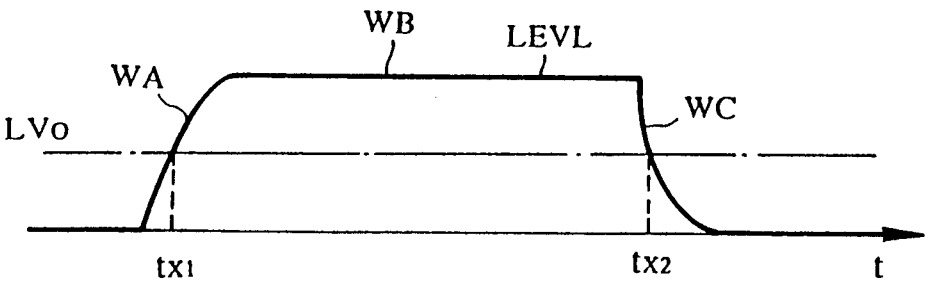
FIG. 27 shows a signal waveform used for explaining the operation of the third embodiment.

Therefore, in the case where the level designating signal LEVL exceeds the level $LV_O$, the level designating signal LEVL can be controlled as the waveform shown in FIG. 27 which includes an attack waveform portion WA, sustain waveform portion WB and release waveform portion WC. In this case, the fundamental waveform data read at time $t_{x1}$ in the attack waveform portion WA differs from that read at time $t_{x2}$ in the release waveform portion WC.

Under control of LEVL as shown in FIG. 27, it is possible to generate the musical tone of which expression can be further improved.

(5) In the foregoing embodiments, the pitch variation of the pitch designating signal PICH is produced based on the initial-touch signal INTL and after-touch signal AFTR. Instead, it is possible to cause the pitch variation by use of a pitch control operator such as glide, pitch-bend etc.

(6) The first embodiment described before uses the level information, pitch information and key code information as three musical tone control parameters corresponding to three-dimensional address information in the three-dimensional coordinate address system of the waveform memory 2. However, it is possible to increase the number of the musical tone control parameters to "n" (where $n>3$), including time information, and operator output information corresponding to the operators to be provided. In this case, an n-dimensional coordinate address system is constructed in the waveform memory 2, wherein each of n musical tone control parameters is assigned to each of n coordinate axes. Thus, based on n musical tone control parameters, the fundamental waveform data is designated and then read from the waveform memory 2.

(7) The foregoing embodiments disclose the musical tone signal generating apparatus which is applied to the monophonic electronic musical instrument. However, it is possible to apply the present invention to the polyphonic electronic musical instrument.

(8) In the foregoing embodiments, the key code signal KC obtained by operating the keyboard portion 4 is used as the musical tone control parameter indicative of the tone pitch, by which the coordinate address in the k-coordinate-axis direction is selected. However, the present invention is not limited to such embodiments. Therefore, it is possible to apply the present invention to another type of electronic musical instrument which does not provide the keyboard portion but the tone source unit, rhythm machine etc.

(9) In the waveform memory 2 as shown in FIG. 14, the interpolation operations are sequentially carried out on the fundamental segment waveform data S2 by use of the weighted coefficient $c_v$ in the j-coordinate-axis direction, $b_u$ in the i-coordinate-axis direction and $a_w$ in the k-coordinate-axis direction in turn. However, it is possible to change such order of carrying out the interpolation operation.

(10) In the second embodiment as shown in FIGS. 20 to 23, the fundamental segment waveform data $f_{ijk}$ are disposed in accordance with the coordinate addresses in the j-coordinate-axis and k-coordinate-axis directions, so that the desirable fundamental segment waveform data is selected based on the level variation of the level designating signal LEVL. Instead or in addition, it is possible to dispose the fundamental segment waveform data in the coordinate address in the i-coordinate-axis direction, so that the desirable fundamental segment waveform data is selected based on the pitch variation of the pitch designating signal PICH. Thus, it is possible to smoothly connect the fundamental segment waveforms when changing over the waveforms in the i-coordinate-axis direction.

(11) The foregoing embodiments embody the present invention by the hardware construction. Instead, it is possible to process the signals by use of software.

(12) As shown in FIGS. 8 to 13, the interpolation synthesizing operation is carried out between coordinate addresses i & i+1, j & j+1, k & k+1 to thereby obtain the inserted address position $(i+b_u, j+c_v, k+a_w)$ based on the coordinate address (i, j, k). Instead of such inserted address positions, it is possible to obtain another inserted address position $(i+(1-b_u), j+(1-c_v), k+(1-a_w))$. In this case, it is also possible to obtain the same effects of the foregoing embodiments.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone signal generating apparatus comprising:

(a) waveform data storing means for storing waveform data, said waveform data storing means including plural memory areas, each memory area having an address corresponding to a coordinate position in an n-dimensional coordinate address system, of which each coordinate axis corresponds respectively to each of n musical tone control parameters, where n denotes an integer having a value of 2 or greater;

(b) musical tone designating means for generating musical tone designating information indicative of a musical tone to be generated;

(c) generating means for generating musical tone control parameter information in response to said musical tone designating information;

(d) reading means for reading said fundamental waveform data from said waveform data storing means by employing said musical tone control parameter information to determine a coordinate position along the n coordinate axes in said n-dimensional coordinate address system and providing the read fundamental waveform data as a musical tone waveform signal;

(e) converting means for converting said musical tone waveform signal into a musical tone signal; and (f) means for generating a musical tone in accordance with said musical tone signal.

2. A musical tone signal generating apparatus according to claim 1 wherein said n-dimensional coordinate address system is a three-dimensional coordinate address system and three musical tone control parameters are respectively assigned to each of three coordinate axes, and wherein one of said three musical tone control parameters is a musical tone control parameter indicative of an envelope of the musical tone.

3. A musical tone signal generating apparatus according to claim 1 wherein said n-dimensional coordinate address system is a three-dimensional coordinate address system and three musical tone control parameters are respectively assigned to each of three coordinate axes, and wherein said musical tone control parameters indicate a key code, a pitch variation and an envelope of the musical tone, respectively.

4. A musical tone signal generating apparatus comprising:

(a) waveform data storing means, having a plurality of memory areas, for storing fundamental waveform data corresponding to a plurality of musical tone control parameters at respective memory areas, each having a predetermined address;

(b) musical tone designating means for generating musical tone designating information indicative of a designated musical tone;

(c) generating means for generating musical tone control parameter information in response to said musical tone designating information;

(d) extracting means for deriving addresses in said waveform data storing means from said musical tone control parameter information and for extracting desired fundamental waveform data corresponding to said musical tone designating information from said fundamental waveform data by use of said addresses and for providing a musical tone waveform signal formed by said extracted fundamental waveform data;

(e) weighted coefficient generating means for generating one or more weighted coefficients with respect to fundamental waveform data included in said musical tone waveform signal;

(f) interpolation means for carrying out an interpolation operation on said fundamental waveform data in said musical tone waveform signal by multiplying each fundamental waveform data by each weighted coefficient and then synthesizing its multiplication result to thereby form an interpolated musical tone waveform signal;

(g) converting means for converting said interpolated musical tone waveform signal into a musical tone signal; and (h) means for generating a musical tone in accordance with said musical tone signal.

5. A musical tone signal generating apparatus according to claim 4 wherein first and second weighted coefficients representative of a certain value and its complement are set with respect to each musical tone control parameter, said interpolation operation being carried out by multiplying first and second fundamental waveform data by said first and second weighted coefficients respectively and synthesizing its multiplication result so that said interpolated musical tone waveform signal indicative of a musical tone waveform which is intermediate to waveforms of said first and second fundamental waveform data is formed.

6. A musical tone signal generating apparatus comprising:

(a) waveform data storing means for storing fundamental waveform data corresponding to level variations, said waveform data storing means having a plurality of memory areas each having a predetermined address;

(b) musical tone designating means for generating musical tone designating information indicative of a designated musical tone;

(c) level information generating means for generating time-variable level information in response to said musical tone designating information, said time-variable level information indicating a level variation occurrence in the musical tone waveform;

(d) extracting means for deriving addresses in said waveform data storing means from said time-variable level information and for extracting desired fundamental waveform data corresponding to said musical tone designating information from said fundamental waveform data by use of said addresses and for providing a musical tone waveform signal formed by said extracted fundamental waveform data;

(e) converting means for converting said musical tone waveform signal into a musical tone signal; and (f) means for generating a musical tone in accordance with said musical tone signal.

7. A musical tone signal generating apparatus comprising:

(a) waveform data storing means for storing fundamental waveform data corresponding to pitch variations, said waveform data storing means having a plurality of memory areas each having a predetermined address;

(b) musical tone designating means for generating musical tone designating information indicative of a designated musical tone;

(c) pitch information generating means for generating time-variable pitch information in response to said musical tone designating information, said time-variable pitch information indicating a pitch variation occurrence in the musical tone waveform;

(d) extracting means for deriving addresses in said waveform data storing means and for extracting desired fundamental waveform data corresponding to said musical tone designating information from said fundamental waveform data by use of said addresses and for providing a musical tone waveform signal formed by said extracted fundamental waveform data;

(e) converting means for converting said musical tone waveform signal into a musical tone signal; and (f) means for generating a musical tone in accordance with said musical tone signal.

8. A musical tone signal generating apparatus comprising:

(a) waveform data storing means for storing fundamental waveform data representing a plurality of fundamental waveforms, the fundamental waveform data for each fundamental waveform stored in a corresponding memory area;

(b) musical tone designation means for generating musical tone designation data which corresponds to a designated musical tone;

(c) musical tone control parameter generating means for generating musical tone control parameters in response to said musical tone designation data;

(d) conversion means for generating a waveform number and at least one weighted coefficient, such that said waveform number corresponds to a fundamental waveform from among said plurality of fundamental waveforms, and further such that each generated weighted coefficient relates to said fundamental waveform to which the generated waveform number corresponds; and (e) extracting means for extracting selected fundamental waveform data corresponding to said musical tone designation data from among said plurality of fundamental waveform data, such that said selected fundamental waveform data is extracted from said waveform data storing means based on memory addresses which are determined in response to said waveform number, and for forming a musical tone waveform signal based on the extracted fundamental waveform data.

* * * * *